US005498511A

United States Patent [19]

Yamashita et al.

[11] Patent Number: 5,498,511

[45] Date of Patent: Mar. 12, 1996

[54] SILVER HALIDE PHOTOGRAPHIC MATERIAL

[75] Inventors: Seiji Yamashita; Mitsuo Saitou; Tomoyuki Ozeki; Tatsuya Ishizaka, all of Kanagawa, Japan

[73] Assignee: Fuji Photo Film Co., Ltd., Kanagawa, Japan

[21] Appl. No.: 325,167

[22] Filed: Oct. 21, 1994

[30] Foreign Application Priority Data

| | | | |
|---|---|---|---|
| Oct. 25, 1993 | [JP] | Japan | 5-287226 |
| Oct. 28, 1993 | [JP] | Japan | 5-271057 |
| Oct. 29, 1993 | [JP] | Japan | 5-272346 |
| Dec. 16, 1993 | [JP] | Japan | 5-316677 |

[51] Int. Cl.[6] ..... G03C 1/035; G03C 5/16; G03C 5/30

[52] U.S. Cl. ..... 430/496; 430/567; 430/569; 430/603; 430/608; 430/435; 430/399

[58] Field of Search ..... 430/567, 569, 430/603, 608, 496, 435, 399

[56] References Cited

U.S. PATENT DOCUMENTS

| | | | |
|---|---|---|---|
| 4,414,304 | 11/1983 | Dickerson | 430/567 |
| 5,292,632 | 3/1994 | Maskasky | 430/567 |
| 5,314,798 | 5/1994 | Brust et al. | 430/567 |

FOREIGN PATENT DOCUMENTS

0534395A1 9/1992 European Pat. Off. .

OTHER PUBLICATIONS

Science and Technology of Photography, Ed. Karlheinz Keller, VCH, New York, 1993.

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

A silver halide photographic material is disclosed, which comprises a support having thereon at least one silver halide emulsion layer, wherein the swelling amount of the hydrophilic colloid layers including the light-sensitive silver halide emulsion layer and a protective layer coated on at least one side of the support is not more than 10 μm in thickness and at least 60% of the total projected area of the total silver halide grains in at least one silver halide emulsion layer includes tabular silver halide grains having a $Cl^-$ content of at least 20 mole %, a {100} plane as the major plane, a thickness of 0.35 μm or less, and an aspect ratio (diameter/thickness) of at least 2, and further a developing process for developing the above silver halide photographic material with a developer containing ascorbic acid or the derivative thereof is disclosed.

12 Claims, No Drawings

SILVER HALIDE PHOTOGRAPHIC MATERIAL

FIELD OF THE INVENTION

The present invention relates to a silver halide photographic material, particularly to a technique having excellent characteristics in the drying property, fixing property, and washing property in rapid photographic processing and greatly inhibiting the occurrence of roller marks in the case of processing with an automatic processor, and more particularly to a silver halide photographic material having a super rapid processing adaptability of dry to dry time of not longer than 60 seconds.

Furthermore, the present invention relates to a method for processing silver halide photographic materials and more specifically to a method for developing black and white photographic materials with a developing agent different from hydroquinone using an automatic processor. Moreover, the present invention relates to a method for processing black and white photographic materials capable of reducing the replenishing amount of a developer per unit area of the photographic material using the developer described above.

BACKGROUND OF THE INVENTION

Recently, as a developing step for photographic light-sensitive materials (hereinafter, is referred to as photographic materials), high-temperature rapid processing has been widely used and in processing various kinds of photographic materials by automatic processors, thus the processing time has been greatly shortened. For attaining rapid processing, it is necessary to have a developer for attaining a sufficient sensitivity in a short time, a photographic material which is excellent in the development proceeding property and gives a sufficient blackened density in a short time, and that the photographic material is capable of being dried in a short time after washing.

As a method generally used for improving the drying property of photographic materials, there is a method in which the water content in a photographic material is reduced before drying thereof by previously adding a sufficient amount of a hardening agent (gelatin crosslinking agent) to the photographic material in the coating step for preparing the photographic material to reduce the swelling amount of the silver halide emulsion layer(s) and the hydrophilic colloid layer(s) thereof in the development-fixing-washing steps. In the method, when a large amount of the hardening agent is used, the drying time can be shortened, but in this case, since the swelling amount of the layers is reduced too much, such that the development is delayed, the sensitivity is lowered, the contrast is lowered, and the covering power in lowered. Also, even when the development proceeding property is improved, the ability to shorten the processing time may be hindered by the delay of the fixing speed caused by the highly hardened layers, which causes the problems of residual silver, residual hypo, and residual colors of sensitizing dyes.

On the other hand, a method for increasing the developing activity of a processing solution is known and it is possible to increase the activity by increasing the amounts of the developing agent and the auxiliary developing agent in a developer, increasing the pH of a developer, and/or increasing the processing temperature. However, these methods all have disadvantages that the preservability of a processing solution is spoiled and even if the sensitivity may be increased, the contrast is lowered and the processed photographic materials are liable to be fogged.

For overcoming the disadvantages described above, a technique of using tabular grain silver halide emulsions is described in U.S. Pat. Nos. 4,439,520, 4,425,425, etc. Also, JP-A-63-305343 and JP-A-1-77047 (the term "JP-A" as used herein means an "unexamined published Japanese Patent application") which disclose a technique of improving the development proceeding property and the sensitivity/fog ratio by controlling the development initiating points of a silver halide grain having (111) planes at or near the tops and/or the edges of the grains. Furthermore, JP-A-58-111933 discloses a radiographic photographic element having a high covering power and without need of supplementing a hardening agent at processing by lowering swelling ratio of hydrophilic colloid layer(s) containing tabular silver halide grains to 200% or less.

These known techniques are excellent techniques in improving the development proceeding property of photographic materials and they have a high utilization value. However, when the processing time for the steps of development, fixing, and washing is shortened, the photographic sensitivity is lowered and the fixing property is deteriorated, resulting in an increase of residual silver and residual hypo. Also, residual colors occur in processing a photographic material that has been subjected to spectral sensitization with sensitizing dyes. Thus, there is a limit in the improvement of photographic properties by the conventional methods of improving silver halide grains because the conventional methods are unable to produce high quality photographic layers. That is, the thickness of the hydrophilic colloid layer(s) determines the fixing property and the production of residual colors and hinders the ability to increase the processing speed.

In regard to the point, JP-A-64-73333, JP-A-64-86133, JP-A-1-105244, JP-A-1-158435, JP-A-1-158436, etc., disclose a means for attaining super rapid processing of the total processing time of from 20 seconds to less than 60 seconds by adjusting the amount of gelatin of the side having hydrophilic colloid layers including silver halide emulsion layer(s) in the range of from 2.00 to 3.50 g/m$^2$ and combining with other technical elements. Also, JP-A-2-68537 discloses a means of attaining super rapid processing by adjusting the weight ratio (silver/gelatin) of silver of light-sensitive silver halides in silver halide emulsions formed to gelatin in the layers to at least 1.5. Furthermore, JP-A-63-221341 discloses a means of attaining super rapid processing of the total processing time of from 20 seconds to 60 seconds by employing silver halide emulsion(s) containing silver halide grains mainly composed of tabular silver halide grains having an aspect ratio of at least 5, adjusting the gelatin amount of the emulsion layers to the range of from 2.00 to 3.20 g/m$^2$ and adjusting the melting time to the range of from 8 minutes to 45 minutes.

Also, JP-A-4-128832 and JP-A-4-324854 disclose a means of attaining super rapid processing by adjusting the coated amount of gelatin, the silver/gelatin ratio of the silver halide emulsion layer(s), and the content of silver iodide in the silver halide grains to the optimum values.

As the result of investigating these prior techniques, the inventors have confirmed that when the amount of a binder such as gelatin, etc., is simply reduced, and when the photographic films are transported by rollers in an automatic processor, the films are rubbed with the rollers forming scratches and causing peeling of the layers. Also, it has been confirmed that when only the swelling ratio of the photographic layers is lowered, the hardness of the layers increases, as described above, causing an increase in residual colors, residual silver, residual hypo, etc., whereby the photographic materials are rendered unsuitable for super rapid processing.

Furthermore, as the result of further investigating the prior techniques described above, the inventors have confirmed that when the amount of gelatin is reduced and/or the silver/gelatin ratio is increased and the coated silver amount is maintained at a constant ratio, abrasion blackening and roller marks increase on the film to a practically unallowable level, whereby the photographic materials cannot be processed by super rapid processing.

The term "abrasion blackening" means that when photographic films are handled and when the films are abraded with each other or the film is abraded with other material, abrasion-shaped blackening is formed after development processing. Also, the term "roller marks" means that when a photographic material is processed by an automatic processor, a pressure is applied to the light-sensitive material by the fine unevenness on the surfaces of the transport rollers, which results in forming a black spot-like uneven density.

When the total processing time is shortened to 60 seconds or less, in particular 40 seconds or less, as the result of properly distributing the times for the development, fixing, and washing steps, when the environmental condition of an automatic processor is a high humidity, it sometimes happens that the drying property of the photographic material is hindered if the swelling amount of the hydrophilic colloid layers of the photographic material is not 10 μm or lower.

As the result of investigating a means of preventing the occurrence of the abrasion and the roller marks when the swelling amount of the hydrophilic colloid layers is not more than 10 μm, the inventors have found that when the amount of silver chloride contained in the silver halide emulsion is increased, there is a tendency of solving the foregoing problem.

On the other hand, in the example of using a tabular grain silver halide emulsion described in JP-A-58-111933, the coated amount of gelatin in the sample is 2.87 g/m$^2$ and hardening is sufficient, whereby there is no problem on drying, but it has been found that when the total processing time is shortened to 40 seconds or less, there are problems with the fixing property and residual colors.

Also, JP-A-2-68537 discloses an example wherein the coated amount of gelatin per one surface side of the support is 2.5 g/m$^2$ and silver chlorobromide and silver bromide each containing no silver iodide are used. However, the sensitivity of silver bromide and silver chlorobromide in the example is greatly lower than that of the tabular silver chlorobromide gains having (100) planes in the present invention.

Silver halide emulsions containing tabular silver halide grains having (100) planes as the major planes are described, e.g., in JP-A-51-88017, JP-B-64-8323 (the term "JP-B" as used herein means an "examined published Japanese Patent application"), and European Patent 0534,395A1.

However, in the tabular grain silver halide emulsion containing silver chloride, the mixing ratio of twin grains is high and the grain size distribution is broad as shown in the silver halide grain photographs of the example of European Patent 0534,395A1. For example, in the photograph shown in FIG. 1 of the European patent specification described above, it is considered that since the number of silver halide grains is large, the reliability of the existence probability thereof is high but according to FIG. 1, the ratio $a_4$=(the total projected area of the twin grains/the total projected area of the (100) plane tabular silver halide grains having an aspect ratio of at least 2) is about 0.11. Also, the coefficient of variation of the grain size distribution of the tabular silver halide grains having a thickness of 0.35 μm or lower is broad. In particular, the diameter distribution of the grains having a large projected area is important for the photographic properties and the diameter distribution is broad. For example, in the case of collecting the tabular silver halide grains in the order of the larger projected area up to 70% of the total projected area, the coefficient of variation (standard deviation/average diameter) of the diameter distribution is over 0.12. Also, the projected area ratio of the tabular grains having the edge ratio (the edge length of the long edge/the edge length of the short edge) of not higher than 1.4 is low. For example, in the photograph shown by FIG. 1 of the foregoing patent specification, the edge ratio is about 0.4. Such values reduce the sensitivity and the gradation of the photographs.

SUMMARY OF THE INVENTION

The 1st object of the present invention is to provide a photographic material which shows a high sensitivity, does not hinder the drying property, the fixing property, and residual colors, and shows a sufficiently practical level in the roller makes even when the photographic material is subjected to super rapid processing.

The 2nd object of the present invention is to improve the developer containing an ascorbic acid as the developing agent for black and white silver halide photographic materials without using hydroquinone and further to provide a method for processing photographic materials with a less replenishing amount per unit area of the photographic material.

It has now been discovered that the objects described above can be attained by the present invention as described hereinbelow.

That is, according to the 1st aspect of the present invention, there is provided a silver halide photographic material comprising a support having thereon at least one silver halide emulsion layer, wherein the swelling amount of the hydrophilic colloid layers including the light-sensitive emulsion layer(s) and protective layer(s) coated on at least one side of the support is not more than 10 μm in thickness and the tabular silver halide grains have a $Cl^-$ content of at least 20 mole %, have (100) planes as the main planes, have a thickness of not more than 0.35 μm, and have an aspect ratio (diameter/thickness) of at least 2 which account for at least 60% of the total projected area of the total silver halide grains contained in at least one silver halide emulsion layer.

Furthermore, according to the 2nd and preferred aspect of the present invention, there is provided a silver halide photographic material of the 1st aspect, wherein the dry thickness of the hydrophilic colloid layers is at least 3.3 μm.

Also, according to the 3rd preferred aspect of the present invention, there is provided a silver halide photographic material of the 1st aspect, wherein the photographic material has at least one silver halide emulsion layer on both sides of the support, the swelling amount of the hydrophilic colloid layers including the emulsion layer, is not more than 8.0 μm on thickness in each side, and at least one silver halide emulsion layer contains tabular silver halide grains having a $Cl^-$ content of at least 20 mole %, having (100) planes as the major planes, having a thickness of not more than 0.35 μm, and having an aspect ratio at least 2 which account for at least 60% of the total projected area of the whole silver halide grains.

According to the 4th preferred aspect of the present invention, there is provided a silver halide photographic material of the 3rd embodiment, wherein the dry thickness of the hydrophilic colloid layers on each side of the support is at least 2.5 μm.

According to the 5th preferred embodiment of the present invention, there is provided a silver halide photographic material of the aspect 1 to 4 described above, wherein the silver halide emulsion also contains twin silver halide grains and the total projected area of the twin silver halide grains is not more than 10% of the total projected area of the tabular silver halide grains in the silver halide emulsion.

According to the 6th preferred embodiment of the present invention, there is provided a silver halide photographic material of the aspect 1 to 4 described above, wherein in the case of collecting the tabular silver halide grains in the silver halide emulsion in the order of the larger projected area up to 70% of the total projected area, the coefficient of variation of the diameter distribution is from 0 to 0.11.

Also, according to the 7th preferred embodiment of the present invention, there is provided a silver halide photographic material of aspects 1 to 4 above, wherein the edge ratio of the tabular silver halide grains (the edge length of the long edge/the edge length of the short edge) is from 1 to 1.4 in at least 47% of the total projected area of the tabular silver halide grains in the silver halide emulsion.

Furthermore, according to the 8th preferred embodiment of the present invention, there is provided a silver halide photographic material, wherein one of the 4 corners of the tabular silver halide grains has a roundish form in at least 10% of the total projected area of the total projected area of the tabular silver halide grains in the silver halide emulsion.

The inventors have further discovered that a stability of a developer and the photographic material system is obtained by processing the foregoing photographic material with the following method.

That is, according to another aspect of the present invention, there is provided a method for developing a silver halide photographic material, wherein at least one silver halide emulsion layer contains tabular silver halide grains having a $Cl^-$ content of at least 10 mole %, having (100) planes as the major planes, having a thickness of not more than 0.35 μm, and having an aspect ratio at least 2 which account for at least 50% of the total projected area of the whole silver halide grains, and wherein a developer contains ascorbic acid or the derivative thereof.

Also, according to a preferred aspect of the present invention of the foregoing aspect, there is provided a developing method, wherein the replenishing amount for the developer is not more than 300 ml/m$^2$.

DETAILED DESCRIPTION OF THE INVENTION

Then, the present invention is described in detail.

In the silver halide emulsion containing at least a dispersing medium and silver halide grains being used in this invention, at least 60%, preferably from 70% to 100%, and more preferably from 80% to 100% of the total projected area of the silver halide grains is tabular silver halide grains having a $Cl^-$ content of at least 20 mole %, preferably from 50 to 100 mole %, more preferably from 75 to 100 mole %, and most preferably from 90 to 100 mole % and having (100) planes as the major planes.

The major plane means the largest surface plane of the tabular grain. The thickness of the tabular silver halide grains is not more than 0.35 μm, preferably from 0.05 to 0.3 μm, and more preferably from 0.05 to 0.25 μm. The aspect ratio (diameter/thickness) of the tabular silver halide grains is at least 2, preferably from 2 to 25, and more preferably from 4 to 20. In this case, the diameter of the tabular silver halide grain means the diameter of a circle having an area equal to the projected area of the tabular grain and the thickness of the tabular grain means a distance between two major planes.

The silver halide emulsion is liable to be intermixed with twin grains and in the silver halide emulsion being used in the present invention, the $a_4$ value (the total projected area of the twin grains/the total projected area of (100) plane tabular grains having the aspect ratio of at least 2) is not more than 0.1, preferably from 0 to 0.08, and more preferably from 0 to 0.05, and most preferably from 0 to 0.02.

The twin grain means a grain having at least one twin plane, wherein the major surface plane is a (111) plane and details thereof are described in Shashin Kogaku no Kiso (*The Basis of Photographic Engineering*), Gin En Shashin hen (*Silver Salt Photography*), Chapter 3, published by Corona K.K., 1979.

Furthermore, the $a_6$ value (the standard deviation of the diameter distribution of tabular silver halide grains in the case of collecting the tabular grains in the order of the larger projected area of the tabular grains up to 70% of the total projected area of the tabular grains) of the tabular silver halide grains is from preferably 0 to 0.11, more preferably 0 to 0.09, far more preferably from 0 to 0.07, and most preferably from 0 to 0.06. Also, preferably at least 47%, more preferably from 55 to 100%, and most preferably from 75 to 100% has the edge ratio (the edge length of the long edge/the edge length of the short edge) of generally from 1 to 1.4, preferably from 1 to 1.3, and more preferably from 1 to 1.2.

The form of the major planes of the tabular silver halide grains is substantially a rectangular parallelogram. However, an embodiment that the corner of the tabular grains is roundish a little is allowable but the ratio (the volume of the lacked portion of the corner/the volume of the grain before the lack) is not more than 0.2 and is frequently from 0 to 0.1. In this case, the volume of the grain before the lack means the volume of the grain when the grain of a rectangular parallelepiped is formed by extending the straight line portions of the corner-lacked grains.

Of the silver halide grains having a high silver chloride content in the present invention, one of the four corners of many of the grains is preferentially rounded. The term "preferentially" means that the volume of the "missing" square portion of the rounded corner is at least twice, frequently at least 4 times, and more frequently at least 8 time the volume of the other portion of the corner. In a preferred embodiment, the $a_7$ value (the total projected area of the tabular grains/the total projected area of the foregoing tabular grains) is preferably at least 0.08, more preferably from 0.15 to 1.0, and most preferably from 0.35 to 1.0.

The mean grain size of said tabular grains is preferably from 0.2 to 10 μm, and more preferably from 0.3 to 5 μm. The $I^-$ content of said tabular grains is preferably not more than 12 mole %, more preferably not more than 6 mole %, and most preferably from 0 to 3 mole %.

The silver halide emulsion being used in the present invention can be produced as follows. Since the silver halide grains preferentially grow to the edge direction, the grains become tabular grains. The defect capable of said preferential growth is called a helical dislocation defect in this invention. The defect is formed at the nucleation by forming at least one, preferably from 1 to 3, and more preferably from 1 to 2 halogen composition gap faces. More preferably, the silver halide emulsion is formed by laminating on an $AgX_1$ layer having a high solubility an $AgX_2$ layer having a solubility lower than that of the $AgX_1$ layer. That is, the formation of the halogen composition gap faces accompanied by a halogen conversion reaction is effective.

Since the solubility is in the order of AgCl>AgBr> AgI, as the $Cl^-$ content is higher and the $I^-$ content is lower, the solubility is said to be higher. More practically, the halogen composition structure of the nucleus formed at the nucleation has the structure of, for example, ($AgX_1$ | $AgX_2$) or ($AgX_1$ | $AgX_4$ | $AgX_3$).

The structure can be formed by simultaneously mixing, for example, an aqueous silver salt solution (hereinafter, is referred to as $Ag^+$ solution) and an aqueous halide solution (hereinafter, is referred to as $X^-$ solution) and discontinuously changing the halogen composition of the $X^-$ solution at the case of forming the gap faces.

Or, the ($AgX_1$ | $AgX_2$) structure can be formed by adding the $X^-$ solution to a dispersion medium solution, then adding the $Ag^+$ solution to the mixture to form $AgX_1$, then adding other $X^-$ solution thereto, and then adding the $Ag^+$ solution and also the structure can be formed by a combined method thereof.

In $AgX_1$ and $AgX_2$, $AgX_1$ and $AgX_4$, or $AgX_4$ and $AgX_3$, the $Cl^-$ content or $Br^-$ content differs from each other by from 25 to 100 mole %, preferably from 50 to 100 mole %, and more preferably from 75 to 100 mole %. Furthermore the $I^-$ content differs from each other by from 5 to 100 mole %, preferably from 10 to 100 mole %, and more preferably from 30 to 100 mole %. In other embodiment, there is a case that the difference of the $Cl^-$ content or the difference of the $Br^-$ content is as described above, and the difference of the $I^-$ content is from 0 to 5 mole %. The size of the nucleus is preferably not larger than 0.15 μm, and more preferably from 0.01 to 0.1μm.

The mole ratio of $AgX_1$:$AgX_2$ in the case of ($AgX_1$ | $AgX_2$) formed by the 2 step addition of the nucleation and the mole ratio of $AgX_1$:$AgX_2$:$AgX_3$ in the case of ($AgX_1$ | $AgX_4$ | $AgX_3$) formed by the 3 step addition of the nuclear formation can be variously changed by a design of experiment and the nuclear mole ratio obtaining the most preferred embodiment of the present invention can be selectively used.

In the case of ($AgX_1$ | $AgX_2$), as the thickness of the $AgX_2$ layer, the amount of covering the surface of the $AgX_1$ layer at least one lattice in average and from the amount of covering 3 lattices to the $10^4$ times mole amount of the $AgX_1$ layer is more preferred. The addition mole amount of the $AgX_4$ layer in the case of ($AgX_1$ | $AgX_4$ | $AgX_3$) is preferably from 0.02 to 10 times mole amount, and more preferably from 0.1 to 3 times mole amount of the addition mole amount of the $AgX_1$ layer. Usually, as the gap difference becomes larger, the frequency of forming the defect becomes higher.

It is necessary that the environment of the dispersion medium solution at nucleation is able to form a (100) plane. In the case of the nucleation which is carried out under an excessive concentration of $Cl^-$, ordinarily almost all the conditions (pCl 0.8 to 3.0, pH 2 to 9) are able to form a (100) plane.

In the pH range of from 1 to 7, the defect forming frequency becomes higher as pH is higher and also becomes higher as the pCl value is higher. In this case, pCl= −log[$Cl^-$ mole/liter].

When many said defects are introduced into one silver halide grain, the frequency of forming thick grains in the silver halide emulsion finally obtained becomes high. Accordingly, a too much defect introducing amount is undesirable. It is necessary to select the defect forming condition such that the silver halide emulsion finally obtained is the embodiment of the present invention. When the gap face formation is uniformly carried out between the nuclei, the embodiment of the present invention is obtained.

The dispersion medium concentration of the dispersion medium solution at the nucleation is preferably from 0.1 to 10% by weight, and more preferably from 0.3 to 5% by weight. The pH value of the dispersion medium solution is preferably from 1 to 10, and more preferably from 2 to 8. The temperature of the dispersion medium solution is preferably from 10° to 80° C., and more preferably from 30° to 60° C. In many cases, as the temperature at the gap face formation is lower, the defect-forming frequency is lowered. This shows that a temperature of higher than a certain extent is necessary for the defect formation.

The excessive $Br^-$ concentration is preferably not higher than $10^{-2}$ mole/liter, and more preferably not higher than $10^{-2.5}$ mole/liter. Also, the excessive $Cl^-$ concentration is preferably from 0.8 to 3.0 and more preferably from 1.2 to 2.8 as pCl.

For enabling the uniform nucleation at the nuclear formation, the silver salt solution and/or the $X^-$ salt solution being added may contain a dispersion medium. In this case, the concentration of the dispersion medium is preferably at least 0.1% by weight, more preferably from 0.1 to 2% by weight, and most preferably from 0.2 to 1% by weight.

As the dispersion medium, low molecular weight gelatin having a molecular weight of from 3,000 to 60,000, and preferably from 8,000 to 40,000 is desirable.

Furthermore, it is more preferred to add the $Ag^+$ solution and the $X^-$ solution to the dispersion medium solution through a porous addition system having number of addition pores of from 3 to $10^{15}$, and preferably from 30 to $10^{15}$. The details thereof are described in JP-A-3- 21339, JP-A-4-193336, and JP-A-6-86923.

In the case of the nucleation, when gelatin having a lower methionine content is used, the defect-forming frequency becomes higher. In this invention, the most preferred gelatin can be used by selecting gelatins having a methionine content of from 1 to 60 μmole/g according to each case.

By lowering the excessive $X^-$ salt concentration or the excessive $Ag^+$ concentration at the nucleation, the mixing ratio of twin particles can be lowered. Furthermore, the mixing ratio is increased as the dispersion medium concentration is lowered or the stirring level is reduced. Accordingly, the conditions may be selected by a try-and-error method such that the silver halide grains finally obtained are in the embodiment of the present invention.

After the formation of the halogen composition gap faces at the nucleation and forming the helical dislocation defects by a halogen conversion reaction in the interface, the silver halide grains formed are ripened by raising the temperature preferably by at least −10° C., and preferably from 20° to 70° C. It is preferred to carry out ripening under the (100) plane forming atmosphere. The ripening condition is preferably selected from the nucleating condition range described above. By ripening, tabular grains are preferentially grown to extinguish nontabular grains, whereby the ratio of tabular grains is increased. In the pH range of from 1 to 6, the ripening speed is usually increased as the pH value becomes high and also in the pCl range of from 1 to 3, the ripening speed is increased as the $Cl^-$ concentration is increased.

After increasing the tabular grain ratio, a solute is added thereto to further grow the tabular grains. As the method of adding the solute, there are 1) an ion addition method (a method of adding the $Ag^+$ solution and the $X^-$ solution), 2) a method of previously forming silver halide fine grains and adding the fine grains to the tabular grains, and 3) a method of combining both the methods described above. For preferentially growing the tabular grains in the edge direction, it is necessary to grow the tabular grains by lowering the super saturated concentration in the range that the tabular grains are not Ostwald-ripened. That is, it is necessary to control the low super saturated concentration at a high accuracy. The method 2) is more preferred for enabling the foregoing matter. Also, the method 2) is preferred since each tabular grain can be uniformly grown.

In the fine grain emulsion addition method, an emulsion of fine silver halide grains having a grain size of not larger than 0.15 μm, preferably not larger than 0.1 μm, and more preferably from 0.06 to 0.006 μm is added to the tabular grains and the tabular grains are grown by the Ostwald-ripening.

The fine grain emulsion can be continuously added to the tabular grains or can be intermittently added to the tabular grains. The fine grain emulsion is continuously prepared by supplying an aqueous silver nitrate solution and the $X^-$ solution into a mixing vessel disposed in the vicinity of the reaction vessel for growing the tabular grains and immediately thereafter is continuously added to the reaction vessel containing the tabular grains, or alternatively after previously preparing the fine grain emulsion in a separate vessel in a batch system, the fine grain emulsion can be continuously or intermittently added to the reaction vessel containing the tabular grains. The fine grain emulsion can be added to the tabular grains as a liquid state or as a powder formed by drying.

In this case, the fine grain emulsion is preferably added in a mode that the fine grains added are vanished within 20 minutes and more preferably in a time of from 10 seconds to 10 minutes. If the vanishing time is long, ripening occurs among the fine grains to increase the grain sizes of the fine grains, which is undesirable. Accordingly, it is preferred not to add the total amount of the fine grain emulsion at a time. Also, it is preferred that the fine grains do not substantially contain multiple twin grains. In this case, the multiple twin grain means a silver halide grain having at least two twin planes per one grain. The term "do not substantially contain" means that the ratio of the multiple twin grain number is not higher than 5%, preferably not higher than 1%, and more preferably not higher than 0.1%.

Furthermore, it is preferred that the fine grains do not substantially contain singlet twin grains. Furthermore, it is also preferred that the fine grains do not substantially contain helical dislocations. In this case, the term "do not substantially contain" is the same as defined above.

The halogen composition of the fine grains is AgCl, AgBr, AgBrI (the $I^-$ content is preferably not higher than 10 mole %, and more preferably not higher than 5 mole %), or a mixed crystal of two or more kinds thereof. Other details can refer to the description of JP-A-6-59360.

At the nucleation, as the dispersion medium at ripening and at grain-growing, a conventionally known dispersion medium for silver halide emulsions can be used but in particular, gelatin having a methionine content of preferably from 0 to 50 μmole/g, and more preferably from 0 to 30 μmole/g can be preferably used. When the gelatin is used at ripening and at grain-growing, thin tabular silver halide grains having a uniform diameter size distribution are preferably formed. Also, the synthetic high molecular compounds described in JP-B-52-16365, *Journal of The Society of Photographic Science and Technology of Japan,* Vol. 29(1), 17, 22(1966), ibid., Vol. 30(1), 10, 19(1967), ibid., Vol. 30(2), 17(1967), and ibid., Vol. 33(3), 24(1967) can be preferably used as the dispersion medium. Also, the crystal habit restraining agent described in European Patent Publication 0534395A1 can be used together.

The concentration of the dispersion medium is preferably from 0.1 to 10% by weight and the restraining agent can be used at a concentration of preferably from $10^{-1}$ to $10^{-6}$ mole/liter, and more preferably from $10^{-2}$ to $10^{-5}$ mole/liter. They can be added to the system at any time from before the nucleation to the end of the grain growth. The dispersion medium can be added in the form of supplemental addition to the existing dispersion medium or can be added to the system after removing the existing dispersion medium by centrifugal separation.

In regard to the dispersion medium concentration, pH, the concentration of the $X^-$ solution and the addition method of the $Ag^+$ solution and the $X^-$ solution at ripening and the grain-growth (the use of the porous addition system, the addition of the dispersion medium) can refer to the foregoing description of the nucleation.

The temperature is preferably at least 25° C., and more preferably from 30° to 80° C. Also, it is preferred that the crystal growth is carried out under the (100) plane-forming atmosphere.

The (100) plane-forming atmosphere described above means the condition that when the nucleation, ripening, or the crystal growth is carried out under each condition, from 60 to 100%, preferably from 80 to 100%, and more preferably from 90 to 100% of the surfaces of the grains become (100) planes. The plane ratio can be measured using the method described in T. Tani, *Journal of Imaging Science,* Vol 29, 165(1985).

As other production method of silver halide grains being used in the present invention, there are following methods.

That is, there are 1) a method of selectively growing tabular grains under a low super saturation concentration after the nucleation and increasing the size difference between the tabular grains and nontabular grains, and extinguishing the nontabular grains by the Ostwald ripening and 2) a method of raising the temperature at least 10° C. after the nucleation, and growing the tabular grains under a low super saturation atmosphere for carrying out the Ostwald ripening. That is, tabular grains are grown with the extinguish of fine grains other than the tabular grains. By such a careful investigation, the silver halide grains of the present invention can be obtained.

The tabular silver halide grains are silver halide grains mainly composed of silver chloride but the tabular grains can have various halogen composition structures in the grains. As a practical example, there are the multiple structure grains described in Japanese Patent Application No. 5-96250. That is, there are the embodiment that the $Br^-$ content and/or the $I^-$ content is increased at the surfaces of the grains, the embodiment that the foregoing content is increased at the edge portions of the grains, the embodiment that the content is increased in the interlayer of the grains, and the embodiment that the content is increased on the major planes of the grains.

Furthermore, it is preferred for obtaining a high sensitivity and a high image quality that the tabular silver halide grains being used in the present invention have a layer containing a silver salt having a solubility lower than that of silver chloride at the surface thereof and/or the inside thereof except for the nucleus.

As the silver salt having a solubility lower than that of silver chloride, there are preferably a silver halobromide, silver haloiodide, silver thiocyanate, and silver selenocyanate. As the silver halobromide, there are preferably silver bromide and silver chlorobromide and silver chloroiodobromide each having a silver bromide content of at least 10%, and preferably at least 20% and as the silver haloiodide, there are silver iodide and silver chloroiodide and silver chloroiodo-bromide each having a silver iodide content of at least 10%, and preferably at least 20%. A combination of them can be used.

Also, the amount of the silver salt having a solubility lower than that of silver chloride contained in the layer containing the silver salt having the low solubility is not more than 80 mole %, preferably not more than 50 mole %, more preferably not more than 25 mole %, and most preferably from $1\times10^{-3}$ mole % to 10 mole %.

As a method for introducing the layer containing the silver salt having a solubility lower than that of silver chloride in the tabular silver halide grains, there are a method that an aqueous water-soluble halide solution and an aqueous water-soluble silver salt solution each having the desired composition are added by a double jet method as the case of forming a core-shell structure and a method of carrying out a halogen conversion. In a preferred embodiment of the present invention, the method carrying out a halogen conversion is employed.

As the method of carrying out the halogen conversion, there are a case of adding solely a salt capable of forming the silver salt having a solubility lower than that of silver chloride, a case of adding a solution of the foregoing salt and an aqueous water-soluble silver salt solution of not more than the equimolar amount by a double jet method, and a case of adding the fine particles of a silver salt having a solubility lower than that of silver chloride. Each of these addition methods is preferably used in the present invention.

In the case of adding the fine particles of the silver salt having a solubility lower than that of silver chloride, the average sphere equivalent diameters of the fine particles are preferably not larger than 0.1 μm, and more preferably not larger than 0.05 μm. Also, the fine particles of the silver salt can be continuously prepared in a mixing vessel disposed in the vicinity of the reaction vessel for forming the tabular silver halide grains by supplying an aqueous silver nitrate solution and an aqueous solution of the salt capable of forming the silver salt having a solubility lower than that of silver chloride and immediately thereafter added to the reaction vessel, or after preparing the fine particles of the silver salt in a separate vessel in a batch system, the fine particles can be added to the reaction vessel.

In the present invention, it is preferred that the formation site and the number ($/cm^2$) of chemical sensitizing centers are restrained. In regard to these matters, the descriptions of JP-A-2-838, JP-A-2-146033, JP-A-1-201651, JP-A-3-121445, JP-A-62-74540, JP-A-4-308840, JP-A-4-343348 and Japanese Patent Application No. 3-140712 can be referred to.

Also, a shallow internal latent image type silver halide emulsion may be formed using the tabular grains as the cores. Also, core/shell type silver halide grains can be formed. In regard to these techniques, the descriptions of JP-A-59-133542 and JP-A-63-151618 and U.S. Pat. Nos. 3,206,313, 3,317,322, 3,761,276, 4,269,927, and 3,367,778 can be referred to.

The silver halide emulsion being used in the present invention produced as described above can be used as a blend with other one or more kinds of silver halide emulsions.

There is no particular restriction on the additives capable of adding to these silver halide emulsions between the grain formation and the coating step and conventionally known photographic additives can be desirably used. For example, there are silver halide solvents, doping agents into silver halide grains (e.g., compounds of noble metals belonging to group VIII of the periodic table, compounds of other metals, chalcogen compounds, thiocyanate compounds, etc.), dispersion media, antifoggants, sensitizing dyes (for blue, green, red, infrared, panchromatic, orthochromatic, etc.), supersensitizers, chemical sensitizers (compounds of sulfur, selenium, tellurium, gold, or noble metals belonging to group VIII, phosphorus compounds, Rhodan compounds, reductive sensitizers, solely or two or more kinds together), fogging agents, emulsion precipitants, surface active agents, hardening agents, dyes, color image-forming agents, color photographic additives, soluble silver salts, latent image stabilizers, developers (hydroquinone series compounds, etc.), pressure desensitization inhibitors, matting agents, etc.

In the present invention, selenium sensitizers can be preferably used in the present invention for obtaining a more high sensitivity and as the selenium sensitizers, conventionally known selenium compounds can be used. That is, usually, a unstable type selenium compound and/or a non-unstable type selenium compound is added to the silver halide emulsion and the emulsion is stirred for a definite time at a high temperature of, preferably, at least 40° C.

As the unstable type selenium compound, the compounds described in JP-B-41-15748, JP-B-43-13489, JP-A-4-25832, JP-A-4-107442, etc., are preferably used.

As specific examples of the unstable selenium sensitizer, there are isoselenocyanates (e.g., aliphatic isoselenocyanates such as allylisoselenocyanate), selenoureas, selenoketones, selenoamides, selenocarboxylic acids (e.g., 2-selenopropionic acid, and 2-selenobutyric acid), selenoesters, diacylselenides [e.g., bis(3-chloro-2,6-dimethoxybenzoyl)selenide], selenophosphates, phosphineselenides, and colloidal metal selenium.

Although preferred examples of the unstable type selenium compounds are shown above but they do not limit the invention in any way. For the technical experts in the field of the art, provided that unstable type selenium compounds are sensitizers for silver halide emulsions, the structure of the compounds is not so important if selenium is unstable and it is generally understood that the organic moiety of a selenium sensitizer molecule has no role except that it carries selenium and makes the selenium exist in a silver halide emulsion in a unstable form. In the present invention, the unstable selenium compounds of such a wide concept are advantageously used.

As the non-unstable type selenium compound being used in the present invention, the compounds described in JP-B-46- 4553, JP-B-52-34492, and JP-B-52-34491 are used. Examples of the non-unstable type selenium compound are selenious acid, potassium selenocyanide, selenazoles, the quaternary salts of selenazoles, diaryl selenide, diaryl diselenide, dialkyl selenide, dialkyl diselenide, 2-selenazolidinedione, 2-selenoxazolidinethione and the derivatives of them.

In these selenium compounds, the selenium compounds represented by formulae (I) and (II) are preferred.

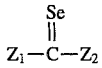

(I)

wherein $Z_1$ and $Z_2$, which may be the same or different, each represents an alkyl group (e.g., methyl, ethyl, t-butyl, adamantyl, and t-octyl), an alkenyl group (e.g., vinyl and propenyl), an aralkyl group (e.g., benzyl and phenetyl), an aryl group (e.g., phenyl, pentafluorophenyl, 4-chlorophenyl, 3-nitrophenyl, 4-octylsulfamoylphenyl, and α-naphthyl), a heterocyclic group (e.g., pyridyl, thienyl, furyl, and imidazolyl), —$NR_1(R_2)$, —$OR_3$, or —$SR_4$ [wherein $R_1$, $R_2$, $R_3$, and $R_4$, which may be the same or different, each represents an alkyl group, an aralkyl group, an aryl group, or a heterocyclic group, examples of the alkyl group, the aralkyl group, the aryl group, and the heterocyclic group being same as those described above for $Z_1$ and $Z_2$, and in this case, $R_1$ and $R_2$ may be a hydrogen atom or an acyl group (e.g., acetyl, propanoyl, benzoyl, heptafluorobutanoyl, difluoroacetyl, 4-nitrobenzoyl, α-naphthoyl, and 4-trifluoromethylbenzoyl)].

In formula (I) described above, $Z_1$ preferably represents an alkyl group, an aryl group, or –$NR_1(R_2)$ and $Z_2$ preferably represents —$NR_5(R_6)$. In this case, $R_1$, $R_2$, $R_5$, and $R_6$, which may be the same or different, each represents a hydrogen atom, an alkyl group, an aryl group, or an acyl group.

In the selenium compounds represented by formula (I), more preferred compounds are N,N-dialkylselenourea, N,N,N' -trialkyl-N'-acylselenourea, tetraalkylselenourea, N,N-dialkyl-arylselenoamide, and N-alkyl-N-aryl-arylselenoamide.

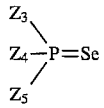

(II)

wherein $Z_3$, $Z_4$, and $Z_5$, which may be the same or difference, each represents an aliphatic group, an aromatic group, a heterocyclic group, —$OR_7$, —$NR_8(R_9)$, —$SR_{10}$, —$SeR_{11}$, $X_1$, or a hydrogen atom (wherein $R_7$, $R_{10}$, and $R_{11}$ each represents an aliphatic group, an aromatic group, a heterocyclic group, a hydrogen atom, or a cation; $R_8$ and $R_9$ each represents an aliphatic group, an aromatic group, a heterocyclic group, or a hydrogen atom; and X represents a halogen atom.

In the formula (II), the aliphatic group represented by $Z_3$, $Z_4$, $Z_5$, $Z_7$, $Z_8$, $Z_9$, $R_{10}$, and $R_{11}$ represents a straight chain, branched, or cyclic alkyl group, alkenyl group, alkinyl group or aralkyl group (e.g., methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentinyl, benzyl, and phenethyl).

In the formula (II), the aromatic group represented by $Z_3$, $Z_4$, $Z_5$, $Z_7$, $Z_8$, $Z_9$, $R_{10}$, and $R_{11}$ represents a monocyclic or condensed cyclic aryl group (e.g., phenyl, pentafluorophenyl, 4-chlorophenyl, 3-sulfophenyl, α-naphthyl, and 4-methylphenyl).

In the formula (II), the heterocyclic group represented by $Z_3$, $Z_4$, $Z_5$, $Z_7$, $Z_8$, $Z_9$, $R_{10}$, and $R_{11}$ represents a 3- to 10-membered ring saturated or unsaturated group (e.g., pyridyl, thienyl, furyl, thiazolyl, imidazolyl, and benzimidazolyl).

In the formula (II), the cation represented by $R_7$, $R_{10}$, and $R_{11}$ represents an alkali metal atom or ammonium and the halogen atom represented by $X_1$ represents, for example, fluorine, chlorine, bromine, or iodine.

In the formula (II), $Z_3$, $Z_4$, or $Z_5$ preferably represents an aliphatic group, an aromatic group, or —$OR_7$ (wherein $R_7$ represents an aliphatic group or an aromatic group).

In the selenium compounds represented by the formula (II), the more preferred compound is trialkylphosphine selenide, triarylphosphine selenide, trialkylseleno phosphate, or triarylseleno phosphate.

Then, specific examples of the compounds represented by the formulae (I) and (II) are shown below, but the present invention is not limited by these compounds.

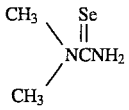

I-1.

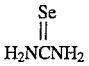

I-2.

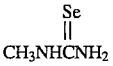

I-3.

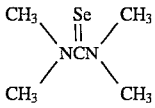

I-4.

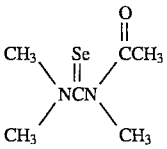

I-5.

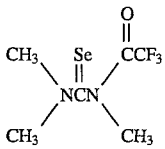

I-6.

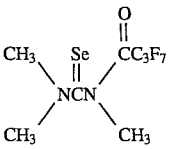

I-7.

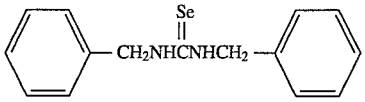

I-8.

Furthermore, as the tellurium sensitizer being used in the present invention, the compounds described in U.S. Pat. Nos. 1,623,499, 3,320,069, and 3,772,031, British Patents 235,211, 1,121,496, 1,295,462, and 2,396,696, Canadian Patent 800,958, *Journal of Chemical Society Chemical Communication,* 635(1980), ibid., 1102(1979), ibid., 645(1979), *Journal of Chemical Society Perkin Transaction,* 1, 2191(1980), etc., are preferably used.

Specific examples of the tellurium sensitizer which can be used in the present invention are colloidal tellurium, telluroureas (e.g., allyltellurourea, N,N-dimethyltellurourea, tetramethyltellurourea, N-carboxyethyl-N',N'-dimethyltellurourea, N,N'-dimethylethylenetellurourea, and N.N'-diphenylethylenetellurourea), isotellurocyanates (e.g., allylisotellurocyanate), telluroketones (e.g., telluroacetone and telluroacetophenone), telluroamides (e.g., telluroacetamide and N,N-dimethyltellurobenzamide), tellurohydrazides (e.g., N,N',N'-trimethyltellurobenzhydrazide), telluroesters (e.g., t-butyl-t-hexyltelluroester), phosphine tellurides (e.g., tributylphosphine telluride, tricyclohexylphosphine telluride, triisopropylphosphine telluride, butyldiisopropylphosphine telluride, and dibutylphenylphosphine telluride), and other tellurium compounds (e.g., the negatively charged telluride ion-containing gelatin described in British Patent 1,295,462, potassium telluride, potassium tellurocyanate, telluropentathionate sodium salt, and allyl tellurocyanate).

In these tellurium compounds, the compounds represented by formulae (III) and (V) are preferred.

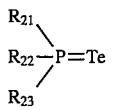

(III)

wherein $R_{21}$, $R_{22}$, and $R_{23}$ each represents an aliphatic group, an aromatic group, a heterocyclic group, $OR_{24}$, $NR_{25}(R_{26})$, $SR_{27}$, $OSiR_{28}(R_{29})(R_{30})$, $X_2$, (wherein $R_{24}$ and $R_{27}$ each represents an aliphatic group, an aromatic group, a heterocyclic group, a hydrogen atom or a cation; $R_{25}$ and $R_{26}$ each represents an aliphatic group, an aromatic group, a heterocyclic group, or a hydrogen atom; $R_{28}$, $R_{29}$, and $R_{30}$ each represents an aliphatic group; and $X_2$ represents a halogen atom) or a hydrogen atom.

In the formula (III), $R_{21}$, $R_{22}$, and $R_{23}$ each preferably represents an aliphatic group or an aromatic group, and more preferably represents an alkyl group or an aromatic group.

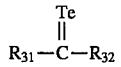

(IV)

wherein $R_{31}$ represents an aliphatic group, an aromatic group, a heterocyclic group, or $—NR_{33}(R_{34})$ and $R_{32}$ represents $—NR_{35}(R_{36})$, $—N(R_{37})N(R_{38})R_{39}$, or $—OR_{40}$ (wherein $R_{33}$, $R_{34}$, $R_{35}$, $R_{36}$, $R_{37}$, $R_{38}$, $R_{39}$, and $R_{40}$ each represents a hydrogen atom, an aliphatic group, an aromatic group, a heterocyclic group, or an acyl group). In the formula, $R_{31}$ and $R_{35}$, $R_{31}$ and $R_{37}$, $R_{31}$ and $R_{38}$, $R_{31}$ and $R_{40}$, $R_{33}$ and $R_{35}$, $R_{33}$ and $R_{37}$, $R_{33}$ and $R_{38}$, and/or $R_{33}$ and $R_{40}$ may combined each other to form a ring.

In the formula (IV), $R_{31}$ preferably represents an aliphatic group, an aromatic group, or $—NR_{33}(R_{34})$; $R_{32}$ preferably represents $—NR_{35}(R_{36})$; and $R_{33}$, $R_{34}$, $R_{35}$, and $R_{36}$ each preferably represents an aliphatic group or an aromatic group.

In the formula (IV), more preferably, $R_{31}$ represents an aromatic group or $—NR_{33}(R_{34})$; $R_{32}$ represents $—NR_{35}(R_{36})$; and $R_{33}$, $R_{34}$, $R_{35}$, and $R_{36}$ each represents an alkyl group or an aromatic group. Also, it is more preferred that $R_{31}$ and $R_{35}$ and/or $R_{33}$ and $R_{35}$ forms a ring via an alkylene group, an arylene group, an aralkylene group, or an alkenylene group.

Then, specific examples (illustrated compounds) of the compounds represented by the formulae (III) and (IV) being used in the present invention are shown below but the compounds in the present invention are not limited by them.

$(nC_4H_9)_3P=Te$ III-1.

$(tC_4H_9)_3P=Te$ III-2.

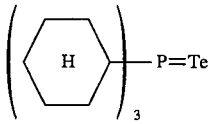

III-3.

$((i)C_3H_7)_3P=Te$ III-4.

-continued

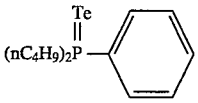

III-5.

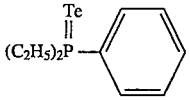

III-6.

$((i)C_4H_9)_3P=Te$ III-7.

$((i)C_4H_9)_2PC_4H_9(n)$ III-8.

$(i)C_3H_7P(C_4H_9(n))_2$ III-9.

$((i)C_3H_7)_2P(C_4H_9(n))$ III-10.

The compounds represented by te formulae (III) and (IV) being used in the present invention can be synthesized according to known methods. For example, these compounds can be synthesized by the methods described in *Journal of Chemical Society* (*A*), 2927(1969); *Journal of Organometallic Chemistry,* 4,320(1965); ibid., 1,200(1963); ibid., 113.C35(1976); *Phosphorus Sulfur,* 15,155(1983); *Chem. Ber.,* 109, 2996(1976); *Journal of Chemical Society Chemical Communication,* 635(1980); ibid., 1102(1976); ibid., 645(1979); ibid., 820(1987); *Journal of Chemical Society Perkin Transaction,* 1, 2191(1980); and *The Chemistry of Organo Selenium and Tellurium Compounds,* Vol. 2, 216– 267(1987).

The using amount of the tellurium sensitizer being used in the present invention depends upon the kind of the silver halide grains being used, the chemical ripening condition, etc., but is generally from $10^{-8}$ to $10^{-2}$ mole, and preferably from about $10^{-7}$ to $10^{-3}$ mole per mole of silver halide.

There is no particularly restriction on the condition of the chemical sensitization in the present invention but pAg is generally from 6 to 11, and preferably from 7 to 10 and the temperature is generally from 40° to 95° C., and preferably from 45° to 85° C.

In the present invention, it is preferred to use a noble metal sensitizer composed of gold, platinum, palladium, iridium, etc., together with the foregoing selenium sensitizer or tellurium sensitizer. In a particularly preferred embodiment, a gold sensitizer is used together and specific examples of the gold sensitizer are chloroauric acid, potassium chloroaurate, potassium auritiocyanate, gold sulfide, and gold selenide. The gold sensitizer can be used in an amount of from about $10^{-7}$ to $10^{-2}$ mole per mole of silver halide.

Furthermore, in the present invention, it is also preferred to use a sulfur sensitizer together with the foregoing selenium sensitizer or tellurium sensitizer. As such a sulfur sensitizer, there are known unstable sulfur sensitizers such as thiosulfates (e.g., hypo), thioureas (e.g., diphenylthiourea, triethylurea, and allylthiourea), rhodanines, etc., and the sulfur sensitizer can be used in the amount of from about $10^{-7}$ to $10^{-2}$ mole per mole of silver halide.

Moreover, in the present invention, it is also preferred to use a reduction sensitizer together with the foregoing selenium or tellurium sensitizer.

As the method of the reduction sensitization being used in the present invention, the reduction sensitization can be carried out using a so-called reduction sensitizer such as ascorbic acid and thiourea dioxide or other compound such as stannous chloride, aminoiminomethane sulfinic acid, hydrazine derivatives, borane compounds, silane compounds, polyamine compounds, etc. Also, the reduction sensitization can be carried out by ripening the silver halide emulsion while maintaining pH of the emulsion 7 or more and pAg 8.3 or less. Furthermore, the reduction sensitization can be carried out by introducing the single addition portions of silver ions during the formation of the silver halide grains.

In the photographic material of the present invention, at least one light-sensitive silver halide emulsion layer may be formed on one side of a support or may be formed on both sides of a support.

The photographic material of the present invention can, if necessary, have hydrophilic colloid layer(s) in addition to the light-sensitive silver halide emulsion layer and a protective layer.

In the photographic material of the present invention, when the light-sensitive emulsion layer exists at only one side of a support, the swelling amount at the side is preferably not more than 10 μm and the dry layer thickness is preferably at least 3.3 μm as thickness, and more preferably from 3.3 μm to 5 μm. When the light-sensitive emulsion layer exists at both sides of a support, the swelling amount of the emulsion layer at each side is preferably in the range of not more than 8 μm, and more preferably from 9.0 to 5.0 μm, and particularly preferably from 8 μm to 6 μm as thickness and the dry layer thickness of each layer is preferably at least 2.5 μm, and more preferably from 2.5 μm to 4.0 μm.

It is preferred that the melting time of the photographic material is established to be from 8 minutes to 45 minutes.

The term "melting time" in the present invention means the time at which at least one silver halide emulsion layer constituting a silver halide photographic material begins to melt when the silver halide photographic material cut into a size of 1 cm×2 cm is immersed in an aqueous solution of 1.5% (by weight) sodium hydroxide at 50° C.

The silver halide photographic emulsions being used in the present invention can further contain various kinds of compounds in addition to the silver halide adsorptive materials in the chemical sensitization step in the present invention for preventing the occurrence of fog in the production steps, the storage and photographic processing of the photographic materials or stabilizing the photographic performance of the photographic materials.

For example, the silver halide photographic emulsions can contain any compounds known as antifoggants or stabilizers such as azoles (e.g., benzothiazolium salts, nitroimidazoles, nitrobenzimidazoles, chlorobenzimidazoles, bromobenzimidazoles, nitroindazoles, benzotriazoles, and aminotriazoles); mercapto compounds (e.g., mercaptothiazoles, mercaptobenzothiazoles, mercaptobenzimidazoles, mercaptothiazoles, mercaptotetrazoles, mercaptopyrimidines, and mercaptotrizines); thioketo compounds (e.g., oxadolinethione); azaindenes {e.g., triazaindenes, tetraazaindenes (in particular, 4-hydroxy-substituted (1,3,3a,7)tetraazaindenes), and pentaazaindenes}; benzenethiosulfonic acid; benzenesulfinic acid; benzenesulfonic acid amide, etc.

In particular, nitron and the derivatives thereof described in JP-A-60-76743 and JP-A-60-87322, the mercapto compounds described in JP-A-60-80839, the heterocyclic compounds described in JP-A-57-164735, and the complex salts of heterocyclic compounds and silver (e.g., 1-phenyl-5-mercaptotetrazole silver), etc., can be preferably used.

Also, even when a sensitizing dye is used as the silver halide adsorptive material in the chemical sensitization step, if necessary, a spectral sensitizing dye for other wavelength region may be added to the emulsion.

The silver halide photographic emulsion layer(s) or other hydrophilic colloid layer(s) of the photographic material of the present invention may further contain various surface active agents for the various purposes for the coating aid, the static prevention, the improvement of the sliding property, the improvement of the emulsified dispersion, the sticking prevention, and the improvement of the photographic characteristics (e.g., the development acceleration, hardening, and the sensitization), etc.

As the surface active agent, for example, nonionic surface active agents such as saponin (steroid series), alkylene oxide derivatives (e.g., polyethylene glycol, a polyethylene glycol/polypropylene glycol condensate, polyethylene glycol alkyl ethers, polyethylene glycol alkylaryl ethers, and polyethylene oxide additives of silicone), alkyl esters of saccharose, etc.; anionic surface active agents such as alkylsulfonates, alkylbenzenesulfonates, alkylnaphthalenesulfonates, alkylsulfuric acid esters, N-acyl-N-alkyltaurines, sulfosuccinic acid esters, sulfoalkyl polyoxyethylene alkylphenyl ethers, etc.; amphoteric surface active agents such as alkylbentaines, alkylsulfobentaines, etc.; and cationic surface active agents such as aliphatic or aromatic quaternary ammonium salts, pyridinium salts, imidazolium salts, etc.

In these surface active agents, the anionic surface active agents such as saponin, sodium dodecylbenzenesulfate, sodium di-2-ethylhexyl-α-sulfosuccinate, sodium p-octylphenoxyethoxyethanesulfonate, sodium dodecylsulfonate, sodium triisopropylnaphthalenesulfonate, N-methyloleyltaurine sodium salt, etc.; the cationic surface active agents such as dodecyltrimethylammonium chloride, N-oleoyl-N',N',N'-trimethylammoniodiaminopropane bromide, dodecylpyridium chloride, etc.; and nonionic surface active agents such as betaines (e.g., N-dodecyl-N,N-dimethylcarboxybetaine and N-oleyl-N,N-dimethylsulfobutylbetaine), polyoxyethylene cetyl ether (average polymerization degree n=10), polyoxy-ethylene-p-nonylphenol ether (average polymerization degree= 25), bis(1-polyoxyethylene-oxy-2,4-di-t-pentylphenyl)ethane (average polymerization degree n=15), etc., can be particularly preferably used.

As the antistatic agent being used in the present invention, fluorine-containing surface active agents such as potassium perfluorooctanesulfonate, N-propyl-N-perfluorooctanesulfonylglycine sodium salt, sodium N-propyl-N-perfluorooctanesulfonylaminoethyloxy polyoxyethylenebutanesulfate (n=a), N-perfluorooctanesulfonyl-N',N',N'-trimethylammoniodiaminopropane chloride, N-perfluorodecanoylaminopropyl-N',N'-dimethyl-N'-carboxybetaine, etc.; the nonionic surface active agents described in JP-A-60-80848, JP-A-61-112144, JP-A-62-172343, JP-A-62-173459, etc.; alkali metal nitrates, electrically conductive tin oxide, zinc oxide, vanadium pentaoxide, and the composite oxides obtained by doping these oxides with antimony, etc., can be preferably used.

For the photographic material of the present invention, a matting agent can be used and as the matting agent, the fine particles of organic compounds such as the homopolymer of polymethyl methacrylate or the copolymer of methyl methacrylate and methacrylic acid, starch, etc., as described in U.S. Pat. Nos. 2,992,101, 2,701,245, 4,142,894, and 4,396,706 and inorganic compounds such as silica, titanium dioxide, strontium barium sulfate, etc., can be used. The particle size of the matting agent is generally from 1.0 μm to 10 μm, and preferably from 2 μm to 5 μm.

Also, for the surface layer of the photographic material of the present invention, a lubricant can be used and as the lubricant, the silicone compounds described in U.S. Pat. Nos. 3,489,576 and 4,047,958, colloidal silica described in JP-B-56-23139, paraffin wax, higher fatty acid esters, starch derivatives, etc., can be used.

Furthermore, for the hydrophilic colloid layers of the photographic materials of the present invention, polyols such as trimethylolpropane, pentanediol, butanediol, ethylene glycol, glycerol, etc., can be used as a plasticizer.

As the binder or the protective colloid which can be used for the silver halide emulsion layers, the interlayers, and the surface protective layers of the photographic materials of the present invention, gelatin is advantageously used but other hydrophilic colloids can be also used.

As such hydrophilic colloids, proteins such as gelatin derivatives, graft polymers of gelatin and other polymers, albumin, casein, etc.; cellulose derivatives such as hydroxyethyl cellulose, carboxymethyl cellulose, cellulose sulfuric acid esters, etc.; saccharose derivatives such as sodium alginate, dextran, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc., can be used.

As gelatin, in addition to line-processed gelatin, acid-processed gelatin or an enzyme-processed gelatin may be used and also, the hydrolyzed products or enzyme-decomposition products of gelatin can be used.

In these binders, it is preferred to use dextran having an average molecular weight of not more than 50,000 or polyacrylamide together with gelatin. The methods described in JP-A-63-68837 and JP-A-63-149641 are effectively used in this invention.

The silver halide photographic emulsions and light-insensitive hydrophilic colloid layers in the present invention may contain a inorganic or organic hardening agent. As the hardening agents, for example, chromium salts (e.g., chromium alum and chromium acetate), aldehydes (e.g., formaldehyde, glyoxal, and glutaraldehyde), N-methylol compounds (e.g., dimethylolurea and methylol dimethylhydantoin), dioxane derivatives (e.g., 2,3-bihydroxydioxane), active vinyl compounds (e.g., 1,3,5-triacryloyl-hexahydro-s-triazine, bis(vinylsulfonyl)methyl ether, and N,N'-methylenebis[ β-(vinylsulfonyl)propionamide]), active halogen compounds (e.g., mucochloric acid and mucophenoxychloric acid), isooxazoles, dialdehyde starch, and 2-chloro-6-hydroxytriazinylated gelatin can be used solely or as a combination of them.

In these hardening agents, the active vinyl compounds described in JP-A-53-41221, JP-A-53-57257, JP-A-59-162546, and JP-A-60-80846 and the active halogen compounds described in U.S. Pat. No. 3,325,287 are preferred.

It is preferred that the hydrophilic colloid layers of the photographic material of the present invention is hardened with the hardening agent such that the swelling ratio thereof in water is generally not more than 280%, preferably not more than 220%, and more preferably from 160% to 200%.

The swelling ratio in water in the present invention is measured by a lyophilization method.

That is, when the photographic material is allowed to stand for 7 days under the condition of 25° C., 60% RH, the swelling ratio of the hydrophilic colloid layers is measured. The dry thickness (a) is determined by observing the thickness of the cut piece of the photographic material by a scanning type electron microscope. The swelled layer thickness (b) is determined by lyophilizing the photographic material in the state of being immersed in distilled water of 21° C. for 3 minutes with liquid nitrogen and then observing the layer thickness by a scanning type electron microscope. The swelling ratio (%) is [(b)−(a)]/(a)×100. In addition, (b)−(a) is a swelling degree.

The photographic material of the present invention can contain a plasticizer such as a polymer or an emulsion in the silver halide emulsion layer(s) for improving the pressure characteristics.

For example, for the purpose, British Patent 738,618 discloses a method using a heterocyclic compound, British Patent 738,637 discloses a methol using an alkyl phthalate, British Patent 738,639 discloses a method using an alkyl ester, U.S. Pat. No. 2,960,404 discloses a method using a polyhydric alcohol, U.S. Pat. No. 3,121,060 discloses a method using a carboxyalkyl cellulose, JP-A-49-5017 discloses a method using paraffin and a carboxylate, and JP-B-53-28086 discloses a method using an alkyl acrylate and an organic acid.

There is no particular restriction on the other constructions of the silver halide emulsion layers of the silver halide photographic materials of the present invention and, if necessary, various additives can be used. For example, the binders, the surface active agents, the dyes, the ultraviolet absorbents, the coating aids, the thickeners, etc., described in *Research Disclosure,* Vol. 176, pages 22–28 (December, 1978) can be used.

The silver halide grains or the silver halide emulsions in the present invention can be used for conventionally known all photographic materials such as, for example, black and white silver halide photographic material (e.g., X-ray photographic materials, photographic materials for printing, photographic papers, photographic negative films, microfilms, direct positive photographic materials, super fine grain light-sensitive materials (for a LSI photomask, for a shadow mask, for a liquid crystal mask, etc.)); and color photographic materials (e.g., negative color photographic films, color photographic papers, color reversal photographic films, direct positive color photographic materials, and color photographic materials for silver dye bleaching method). Furthermore, the silver halide emulsions in the present invention can be used for diffusion transfer type photographic materials (e.g., diffusion transfer color photographic elements and silver salt diffusion transfer photographic elements), heat-developable photographic materials (black and white, color), high-density digital recording photographic materials, photographic materials for holography, etc.

As ascorbic acid or the derivatives thereof which are preferably used for the development of the present invention, the compound represented by formula (A) is preferred.

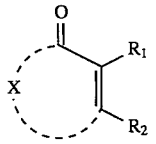

(A)

wherein $R_1$ and $R_2$ each represents a hydroxy group, an amino group, an acylamino group, an alkylsulfonylamino group, an arylsulfonylamino group, an alkoxycarbonylamino group, a mercapto group, or an alkylthio group and X represents a 5- or 6-membered ring composed of carbon atom(s), an oxygen atom, or nitrogen atom(s) together with two vinyl carbons to which $R_1$ and $R_2$ each is substituted and the carbonyl group.

Then, the compounds of formula (A) are explained in detail.

In the formula (A), $R_1$ and $R_2$ each a hydroxy group, an amino group (including the amino group having an alkyl group of from 1 to 10 carbon atoms such as methyl, ethyl, n-butyl, hydroxyethyl, etc., as a substituent), an acylamino group (acetylamino, benzoylamino, etc.), an alkylsylfonylamino group (methanesulfonylamino, etc.), an arylsulfonylamino group (benzenesulfonylamino, p-toluenesulfonylamino, etc.), an alkoxycarbonylamino group (methoxycarbonylamino, etc.), a mercapto group, or an alkylthio group (methylthio, ethylthio, etc.). As preferred examples of the groups represented by $R_1$ and $R_2$, there are a hydroxy group, an amino group, an alkylsulfonylamino group, and an arylsulfonylamino group.

X is a 5- or 6-membered ring composed of carbon atom(s), an oxygen atom, or nitrogen atom(s) together with two vinyl carbons to which $R_1$ and $R_2$ each is substituted and the carbonyl carbon.

Specific examples of X include composed of combinations of —O—, —C($R_3$)($R_4$)—, —C($R_5$)=, —C(=O)—, —N($R_6$)—, and —N= (wherein, $R_3$, $R_4$, $R_5$, and $R_6$ each represents a hydrogen atom, an alkyl group having from 1 to 10 carbon atoms, which may be substituted with a hydroxy group, a carboxy group, or a sulfo group), an aryl group having from 6 to 15 carbon atoms, which may be substituted with an alkyl group, a halogen atom, a hydroxy group, a carboxy group, or a sulfo group, a hydroxy group, or a carboxy group.

Examples of the 5- or 6-membered ring include a dihydrofuranone ring, a dihydropyrrone ring, a pyranone ring, a cyclopentenone ring, a cyclohexenone ring, a pyrrolidone ring, a pyrazolidone ring, a pyridone ring, an azacyclohexenone ring, and a uracil ring. Preferred examples of the 5- or 6-membered ring include a dihydrofuranone ring, a cyclopentenone ring, a cyclohexenone ring, a pyrazolinone ring, an azacyclohexanone ring, and a uracil ring.

Specific examples of the compound represented by formula (A) are shown below.

A-1

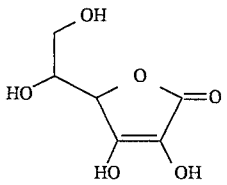

A-2

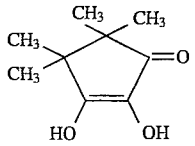

A-3

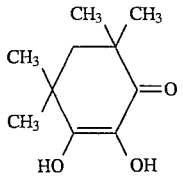

A-4

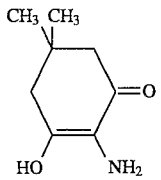

-continued

A-5

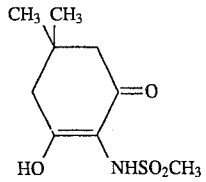

A-6

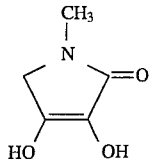

A-7

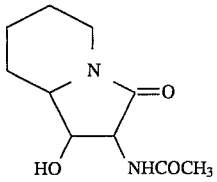

A-8

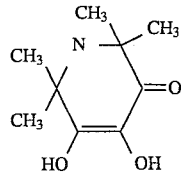

A-9

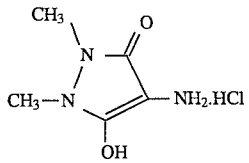

A-10

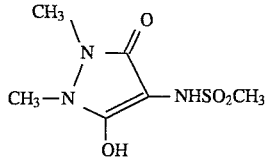

A-11

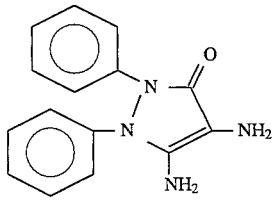

A-12

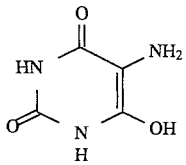

As the ascorbic acids for the developer being used in the present invention, an endiol type ascorbic acid, an enaminol type ascorbic acid, an endiamin type ascorbic acid, a thioenol type ascorbic acid, and an enamin-thiol type ascorbic acid are generally used. These compounds are described in U.S. Pat. No. 2,688,549 and JP-A-62-237443, etc.

Synthesis methods of these ascorbic acids are well known and are described, e.g., in Jiro Nomura and Hirohisa Oomura, *Chemistry of Reduction,* published by Uchida Rokakuho Shinsha, 1969.

The ascorbic acids being used in the present invention can be used as the form of the alkali metal salts such as the lithium salts, the sodium salts, the potassium salts, etc. The ascorbic acid is used for the developer in the amount of generally from 1 to 100 g, and preferably from 5 to 80 g per liter of the developer.

The developer for use in the present invention may further contain a development inhibitor such as potassium bromide, potassium iodide, etc.; an organic solvent such as dimethylformamide, methyl cellosolve, hexylene glycol, ethanol, methanol, etc.; a benzotriazole derivative such as 5-methylbenzotriazole, 5-bromobenzotriazole, 5-chlorobenzotriazole, 5-butylbenzotrizole, benzotriazole, etc., (5-methylbenzotriazole is particularly preferred); and a nitroindazole such as 5-nitroindazole, 6-nitroindazole, 4-nitroindazole, 7-nitroindazole, 3-cyano-5-nitroindiazole, etc., (5-nitroindazole is particularly preferred).

In particular, when a compound such as 5-nitroindazole, etc., is used, the compound is generally previously dissolved in other solvent than a solvent containing the dihydroxybenzene series developing agent and a sulfite series preservative and at use, both solutions are mixed with each other followed by the addition of water.

Furthermore, if necessary, the developer may contain a color toning agent, a surface active agent, a hard-water softener, a hardening agent etc.

The developer also contains a chelating agent and as the chelating agent, there are ethylenediamine diorthohydroxyphenyl acetic acid, diaminopropanetetraacetic acid, nitrilotriacetic acid, hydroxyethyl ethylenediaminetriacetic acid, dihydroxyethylglycine, ethylenediaminediacetic acid, ethylenediamine dipropionic acid, iminodiacetic acid, diethylenetriaminepentaacetic acid, hydroxyethyliminodiacetic acid, 1,3-diaminopropanol tetraacetic acid, triethylenetetraminehexaacetic acid, transcyclohexanediaminetetraacetic acid, ethylenediaminetetraacetic acid, glycol ether diaminetetraacetic acid, ethylenediaminetetrakismethylenephosphonic acid, diethylenetriaminepentamethylenephosphonic acid, nitrirotrimethylenephosphonic acid, 1-hydroxyethylidene-1, 1-diphosphonic acid, 1,1-diphosphonoethane-2-carboxylic acid, 2-phosphonobutane-1,2,4-tricarboxylic acid, 1-hydroxy-1 -phopshonopropane-1,3,3-tricarboxylic acid, catechol-3,5 -disulfonic acid, sodium pyrophosphate, sodium tetrapolyphosphate, sodium hexametaphosphate, etc.

Examples of the particularly preferred chelating agent are diethylenetriaminepentaacetic acid, triethyleneteteamine-hexaacetic acid, 1,3-diaminopropanol tetraacetic acid, glycol ether diaminetetraacetic acid, hydroxyethylethylenediaminetriacetic acid, 2-phosphonobutane-1,2,4-tricarboxylic acid, 1,1-diphosphonoethane-2-carboxylic acid, nitrirotrimethylenephosphoric acid, ethylenediaminetetraphosphonic acid, diethylenetriaminepentaphosphonic acid, 1 -hydroxypropylidene-1,1-diphosphonic acid, 1-aminoethylidene-1,1-diphosphonic acid, 1-hydroxyethylidene-1,1-diphosphonic acid, and the salts of them.

The developer being used in the present invention can further contain the compounds described in JP-B-56-46585, JP-B-62-4702, JP-B-62-4703, U.S. Pat. Nos. 4,254,215 and 3,318,701, JP-A-58-203439, JP-A-62-56959, JP-A-62-178247, JP-A-1-200249, JP-A-5-53257, Japanese Patent Application Nos. 3- 94955 (corresponding to EP 507284A) and 3-112275 (corresponding to EP 507284A), as a silver stain inhibitor.

In the present invention, it is particularly preferred to use a 1-phenyl-3-pyrazolidone or a p-aminophenol together with the ascorbic acid.

As the 3-pyrazolidone series developing agent being used in the present invention, there are 1-phenyl-3-pyrazolidone, 1-phenyl-4,4-dimethyl-3-pyrazolidone, 1-phenyl- 4-methyl-4-hydroxymethyl-3-pyrazolidone, 1-phenyl-4,4 -dihydroxymethyl-3-pyrazolidone, 1-phenyl-5-methyl-3-pyrazolidone, 1-p-aminophenyl-4,4-dimethyl-3-pyrazolidone, 1 -p-tolyl-4,4-dimethyl-3-pyrazolidone, 1-p-tolyl-4-methyl-4 -hydroxymethyl-3-pyrazolidone, etc.

The 3-pyrazolidone series developing agent is preferably used in an amount of from 0.001 mole/liter to 1.2 moles/liter.

As the p-aminophenol series developing agent being used in the present invention, there are N-methyl-p-aminophenol, p-aminophenol, N-(β-hydroxyethyl)-p-aminophenol, N-(4-hydroxyphenyl)glycine, 2-methyl-p-aminophenol, p-benzylaminophenol, etc. In these developing agents, N-methyl-p-aminophenol is preferred.

The developer being used in this invention can further contain a dialdehyde series hardening agent. As the dialdehyde series compound, there are glutaraldehyde, α-methylglutaraldehyde, β-methylglutaraldehyde, maleindialdehyde, succinaldehyde, methoxysuccinaldehyde, methylsuccinaldehyde, α-methoxy-β-ethoxysuccinaldehyde, α-n-butoxyglutaraldehyde, α,α-dimethoxysuccindialdehyde, α,α-diethylsuccindialdehyde, β-isopropylsuccindialdehyde, butylmaleinaldehyde, and the biphosphite addition products of them. Among these, glutaraldehyde and biphosphite addition products thereof are preferred.

The amount of the dialdehyde series hardening agent in the developer is preferably from 0.5 to 100 g, and particularly preferably from 0.5 to 30 g per liter of the developer.

Since the nitroindazole and the dialdehyde series compound described above are gradually deteriorated in the developer, as the forms of processing kit before preparing the developer, the nitroindazole and the dialdehyde series compound should be stored in a neutral or acidic solution as a different part from an alkaline part containing the ascorbic acid.

The pH of the developer being used in this invention is in the range of preferably from 8.5 to 12, and more preferably from 9 to 12.

The alkali agents which can be used for adjusting pH of the developer include a pH controlling agent such as sodium hydroxide, potassium hydroxide, sodium carbonate, potassium carbonate, sodium tertiary phosphate, potassium tertiary phosphate, etc.

As the sulfite preservative being used for the developer in the present invention, there are sodium sulfite, potassium sulfite, lithium sulfite, ammonium sulfite, sodium bisulfite, potassium metabisulfite, etc. The amount of the sulfite is generally at least 0.01 mole/liter, and preferably at least 0.02 mole/liter. Also, the upper limit of the amount of the sulfite is preferably 2.5 moles/liter.

Furthermore, the compounds described in L. F. A. Mason, *Photographic Processing Chemistry,* published by Focal Press, 1966, pages 226–229, U.S. Pat. Nos. 2,193,015 and 2,592,364, JP-A-48-64933 may be used.

In general, a boric acid compound (e.g., boric acid and borax) is frequently used in the developer as a pH buffer, etc., but it is preferred that the developer containing the ascorbic acid being used in the present invention does not substantially contain the boric acid compound. Preferably, the amount of the boric acid compound is preferably 0.5 g or less and particularly preferably 0 g per liter of the developer.

The relation of the effect of this invention by the existence or absence of a boric acid compound in the system of the present invention is an utterly unexpected matter.

Then, the following examples are intended to illustrate the present invention but not to limit it in any way.

Example 1

Preparation of Emulsion A of the Present Invention:

In a reaction vessel, was placed 1,200 ml of an aqueous gelatin solution (containing 18 g of deionized alkali-treated bone gelatin having a methionine content of about 40 μmole/g, pH 4.3) and while maintaining the temperature thereof at 43° C., 12 ml of an "Ag-1 liquid" (containing 20 g of $AgNO_3$, 0.8 g of the gelatin, and 0.2 ml of a 1N $HNO_3$ solution in 100 ml) and 12 ml of an "X-1 liquid" (containing 6.9 g of NaCl, 0.8 g of the gelatin, and 0.3 ml of a 1N HaOH solution in 100 ml) were added to the aqueous gelatin solution by a double jet method at 24 ml/minute. Then, after mixing the mixture for 2 minutes, 19 ml of an "Ag-2 liquid" (containing 2 g of $AgNO_3$, 0.8 g of the gelatin, and 0.2 ml of a 1N $HNO_3$ solution in 100 ml) and 19 ml of an "Ag-2 liquid" (containing 1.4 g of KBr, 0.8 g of the gelatin, and 0.2 ml of a 1N NaOH solution in 100 ml) were added to the mixture by a double jet method at 31 ml/minute. Then, after stirring the mixture for 2 minutes, 36 ml of the "Ag-1 liquid" and 36 ml of the "X-1 liquid" were added to the mixture by a double jet method at 48 ml/minute. Then, 20 ml of a "NaCl-1 liquid" (containing 10 g of NaCl in 100 ml) was added to the mixture, and after adjusting pH of the mixture to 4.8, the temperature thereof was raised to 75° C. Then, after ripening the mixture for 20 minutes, the temperature was lowered to 60° C., and after adjusting the pH to 5.0, an "Ag-3 liquid" (containing 10 g of $AgNO_3$ in 100 ml) and an "X- 3 liquid" (containing 3.6 g of NaCl in 100 ml) were added to the mixture by a controlled double jet method at a silver potential of 130 mV. The flow rate at the initiation of the addition of the liquids was 7 ml/minute, then the liquid were added by accelerating the flow rate at 0.1 ml/minute, and 400 ml of the "Ag-3 liquid" was added.

A precipitant was added to the resulting mixture, the temperature was lowered to 30° C., precipitates formed were collected and washed with water, and after adding thereto an aqueous gelatin solution, the pH and pCl thereof were adjusted to 6.2 and 3.0, respectively, at 38° C. A part of the silver halide emulsion thus formed was sampled and a transmission type electron microphotographic images (hereinafter, is referred to as TEM images) of the replica of the silver halide grains were observed.

The form characteristic values of the silver halide grains are as follows.

(The total projected area of (100) tabular grains having an aspect ratio of at least 2/the sum of the projected area of total silver halide grains)=$a_1$=0.91, the average aspect ratio (average diameter/average thickness) of (100) tabular grains having as aspect ratio of at least 2=$a_2$= 3.4, the average diameter of (100) tabular grains having an aspect ratio of at least 2=$a_3$=1.0 μm, (the total projected area of twin grains/the total projected area of (100) tabular grains having an aspect ratio of at least 2)= $a_4$=0, (the sum of the total projected area of (100) tabular grains having an aspect ratio of at least 2 and an edge ratio of from 1 to 1.4/the sum of the projected area of total silver halide grains)=$a_5$=0.86, (the coefficient of variation of the diameter distribution of (100) tabular grains having an aspect ratio of at least 2 of 70% of the total projected area collected in the order of the larger grains)=$a_6$=0.059, and the average thickness=$a_7$=0.29 μm.

Thereafter, after raising the temperature of the silver halide emulsion thus formed to 60° C., sodium thiosulfate was added to the emulsion, after 2 minutes since then, chloroauric acid and potassium thiocyanate were added to the mixture, and after adding thereto 4-hydroxy-methyl-1,3,3a,7-tetraazaindene after 65 minutes since then, the emulsion was solidified by quickly cooling to provide Emulsion A. The Emulsion A was a high-silver chloride content (100) tabular grain emulsion containing 0.76 mole % silver bromide.

1. Preparation of Comparative Emulsion B:

In one liter of water was dissolved 32 g of gelatin in a vessel heated to 60° C., after adding to the solution in the vessel 0.3 g of potassium bromide, 5 g of sodium chloride, and 46 mg of compound [I] represented by the following formula, Compound [I]:

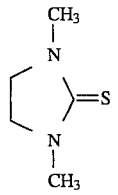

444 ml of an aqueous solution containing 80 g of silver nitrate and 452 ml of an aqueous solution containing 45 g of potassium bromide and 5.5 g of sodium chloride were added thereto by a double jet method over an about 30 minute period, and thereafter, 400 ml of an aqueous solution containing 80 g of silver nitrate and 415 ml of an aqueous solution containing 46.4 g of potassium bromide, 5.7 g of sodium chloride, and potassium hexachloroiridate(III) ($10^{-7}$ mole/mole-silver) by a double jet method over an about 25 minute period to provide an emulsion containing cubic mono-dispersed silver chlorobromide grains (a variation coefficient of the diameters of the projected area: 10%) having an average grain size (diameter of the projected area) of 0.67 μm.

After subjected the emulsion to a desalting treatment by a flocculation method, 62 g of gelatin and 1.75 g of phenoxy ethanol were added to the emulsion, and the pH and pAg thereof were adjusted to 6.5 and 8.5, respectively.

Thereafter, after raising the temperature thereof to 65° C. 2 mg of sodium thiosulfate was added to the emulsion, after 2 minutes since then, 5 mg of chloroauric acid was added, and after adding thereto 512 mg of 4-hydroxy-6-methyl-1,3,3a,7-tetraazaindene after 80 minutes since then, the emulsion was solidified by quickly cooling to provide Emulsion B.

2. Preparation of Emulsion Coating Solution:

To each of the Emulsions A and B were added the following compounds per mole of silver halide to form each emulsion coating solution.

| | | |
|---|---|---|
| a. | Spectral Sensitizing Dye [I] (shown below) | 138 mg |
| b. | Spectral Sensitizing Dye [II] (shown below) | 42.5 mg |
| c. | Polyacrylamide (molecular weight: 40,000) | 8.54 g |
| d. | Trimethylolpropane | 1.2 g |
| e. | Sodium polystyrenesulfonate (average molecular weight: 600,000) | 0.46 g |
| f. | Latex of poly(ethyl acrylate/methacrylic acid) | 32.8 g |
| g. | 1,2-Bis(vinylsulfonylacetamide)ethane | 2 g |

Spectra Sensitizing Dye [I]

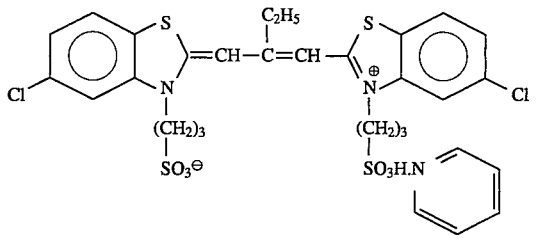

Spectral sensitizing Dye [II]

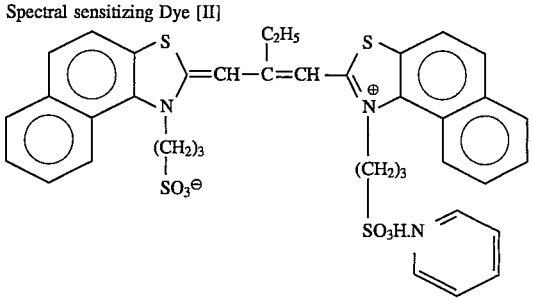

3. Preparation of Surface Protective Layer Coating Solution for Emulsion Layer:

The following compounds were added to a vessel heated to 40° C. to provide the coating solution.

| | | |
|---|---|---|
| a. | Gelatin | 100 g |
| b. | Polyacrylamide (molecular weight: 40,000) | 12.3 g |
| c. | Sodium polystyrenesulfonate (average molecular weight: 600,000) | 0.6 g |
| d. | Polymethyl methacrylate fine particles (average particle size: 2.5 μm) | 2.7 g |
| e. | Sodium polyacrylate | 3.7 g |
| f. | Sodium t-octylphenoxyethoxyethansulfonate | 1.5 g |
| g. | $C_{16}H_{33}O-(CH_2CH_2O)_{10}-H$ | 3.3 g |
| h. | $C_8H_{17}SO_3K$ | 84 mg |
| i. | $C_8F_{17}SO_2N(C_3H_7)(CH_2CH_2O)_4(CH_2)_4-SO_3Na$ | 84 mg |
| j. | NaOH | 0.2 g |
| k. | Methanol | 78 ml |
| l. | 1,2-Bis(vinylsulfonylacetamide)ethane | The amount was adjusted such that the swelled amount became the value shown in Table 1 below. |
| m. | Compound [II] 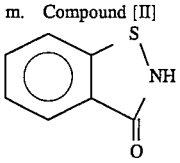 | 52 mg |
| n. | Compound [III] 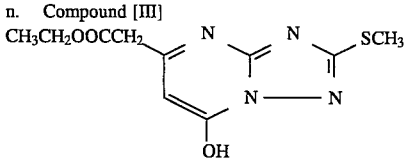 | 60 mg |

4. Preparation of Back Layer Coating Solution:

The following compounds were added to a vessel heated to 40° C. to form the back layer coating solution.

| | | |
|---|---|---|
| a. | Gelatin | 100 g |
| b. | Dye [I] | 2.39 g |

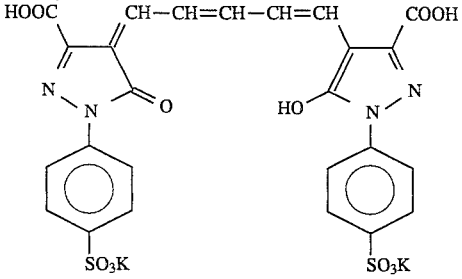

| | | |
|---|---|---|
| c. | Sodium polystyrenesulfonate | 1.1 g |
| d. | Phosphoric acid | 0.55 g |
| e. | Poly(ethyl acrylate/methacrylic acid) latex | 2.9 g |
| f. | Compound [II] (shown above) | 46 mg |
| g. | Oil dispersion described in JP-A-61-285445 of Dye [II] shown below (as dye itself) | 246 mg |

Dye [II]

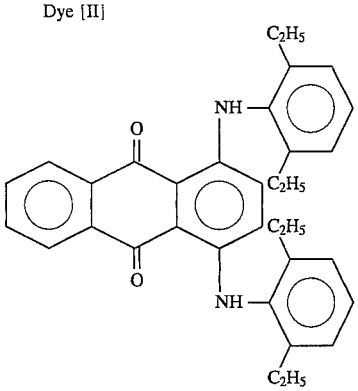

| | | |
|---|---|---|
| h. | Oil dispersion described in JP-A-61-285445 of Dye [III] (as dye itself) | 46 mg |

Dye [III]

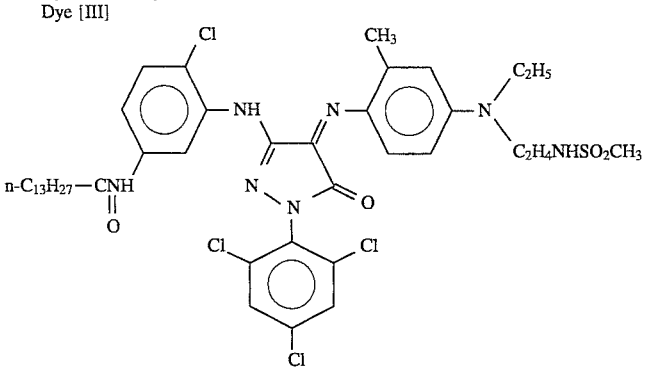

5. Preparation of Surface Protective Layer Coating Solution for Back Layer:

The following compounds were added to a vessel heated to 40° C. to form the coating solution.

| | | |
|---|---|---|
| a. | Gelatin | 100 g |
| b. | Sodium polystyrenesulfonate | 0.3 g |
| c. | Polymethyl methacrylate fine particles (average particle size: 3.5 μm) | 4.3 g |
| d. | Sodium t-Octylphenoxyethoxyethanesulfonate | 1.8 g |
| e. | Sodium polyacrylate | 1.7 g |
| f. | $C_{16}H_{33}O—(CH_2CH_2O)_{10}—H$ | 3.6 g |
| g. | $C_8H_{17}SO_3K$ | 268 mg |

-continued

| | | |
|---|---|---|
| h. | $C_8F_{17}SO_2N(C_3H_7)(CH_2CH_2O)_4(CH_2)_4—SO_3Na$ | 45 mg |
| i. | NaOH | 0.3 g |
| j. | Methanol | 131 mg |
| k. | 1,2-Bis(vinylsulfonylacetamide)ethane | The amount was adjusted to be 2.2% by weight of the total gelatin amount of the back layer and the surface protective layer thereof. |
| l. | Compound [II] (shown above) | 45 mg |

6. Preparation of Coated Samples:

The back layer coating solution and the surface protective layer coating solution described above were coated on one side of a polyethylene terephthalate support colored into a blue color such that the gelatin coated amount of the back layer became 2.69 g/m$^2$ and the gelatin coated amount of the surface protective layer became 1.3 g/m$^2$. Then, the emulsion coating solution and the surface protective layer coating solution described above were coated on the opposite side of the support as shown in Table 1 below to provide Coated Samples 1 to 10.

The sensitivity was shown by the logarithm of the reciprocal of the light exposure amount showing D=1.0 and shown by a relative sensitivity with the sensitivity of the coated sample 6 being taken as 100. Also, the maximum value of the density and the fog value were evaluated.

8. Evaluation of Drying Property:

After allowing to stand each coated sample prepared as the case of the sensitometry, the sample was cut into a size of 35.6 cm×35.6 cm and exposed such that the density became 1.0.

TABLE 1

| Coated Sample No. | Emulsion | Emulsion Layer: Ag Amount (g/m) | Emulsion Layer: Gelatin Amount (g/m$^2$) | Surface Protective Layer: Gelatin Amount (g/m$^2$) | Emulsion Layer: Dry Thickness (μm) | Swelling Amount (Emulsion surface side) (μm) | |
|---|---|---|---|---|---|---|---|
| 1 | A | 2.4 | 1.8 | 1.2 | 3.4 | 8 | Invention |
| 2 | " | " | 2.5 | 1.2 | 4.0 | 9.5 | " |
| 3 | " | " | 1.5 | 1.2 | 3.1 | 7.6 | Invention |
| 4 | " | " | 2.8 | 1.5 | 4.5 | 10.5 | Comparison |
| 5 | B | " | 2.0 | 1.2 | 3.4 | 8.8 | " |
| 6 | " | " | 2.5 | 1.2 | 4.0 | 9.5 | " |
| 7 | " | " | 1.5 | 1.2 | 3.1 | 7.6 | " |
| 8 | " | " | 2.8 | 1.5 | 4.5 | 10.5 | " |
| 9 | A | " | 3.5 | 1.5 | 5.2 | 11.5 | " |
| 10 | A | " | " | " | " | 9.0 | Invention |

The dry thickness and the swelling amount were evaluated after allowing to stand each coated sample at 25° C. and 60% in humidity for 7 days since coating.

7. Sensitometric Method:

On each of the coated samples thus-prepared, a sensitometry was carried out by the following method and the photographic sensitivity was measured.

Each coated sample was allowed to stand at 25° C. and 60% in humidity for 7 days since coating and was light-exposed using 633 nm He-Ne laser exposing portion of AC-1 (manufactured by Fuji Photo Film Co.).

Also, each coated sample was also exposed using an exposure device composed of the improved 780 nm semiconductor laser exposing portion of FCR-7000 (manufactured by Fuji Photo Film Co., Ltd.) equipped with the AlGaInP 5 mW, 678 nm semiconductor laser light emitting portion (manufactured by NEC Corporation).

The exposed samples were developed by CRPROS-M (manufactured by Fuji Photo film Co., Ltd.) using CE-D·F1 (manufactured by Fuji Photo film Co., Ltd.) as the processing solution, at a development temperature of 35° C. and for 45 seconds of dry to dry time.

The sample was developed as in the case of the sensitometry. When 50 samples were continuously processed, the final sample emerged from the outlet of the drying zone was touched and the sample was functionally evaluated by the following ranks.

G: Dried well.

B: Wetted to give a problem.

9. Evaluation of Roller Mark:

The amount of glutaraldehyde in the developer used for the evaluation of the photographic property was reduced to a half. Each coated sample was cut into a size of 30.5 cm×25.4 cm and exposed by the light source of a color temperature of 5400° K. In this case, by increasing or decreasing the exposure time, the density of each sample in the roller mark evaluation treatment was adjusted to become equally 1.0 including the base density. The black spot-form roller mark observed in the samples thus-treated was evaluated. The evaluation standard was by the following functional evaluation.

E: Almost no roller mark.

G: Roller mark formed slightly but no problem.

M: Roller mark formed but allowable for practical use.

B: Roller mark formed too much to use practically (unsuitable for practical use).

10. valuation of Pick Off:

Each sample used for the evaluation of the roller mark was placed on a light table (i.e., on Schaukasten) in the dark and the number of the occurrence of the picked off fine layer was visually determined.

11. Evaluation of Residual Silver:

Each coated sample was cut into a size of 30.5 cm×25.4 cm and treated with washing water of 5° C. in an unexposed state. On the sample, the amount of silver remaining in the emulsion layer was determined using a fluorescent X-ray detection method.

The evaluation results thus obtained are shown in Table 2 below.

TABLE 2

| | Sensitivity | Fog | $D_{max}$ | Drying property | Roller mark | Pick Off | Residual silver ($g/m^2$) |
|---|---|---|---|---|---|---|---|
| 1 | 180 | 0.04 | 2.30 | G | E | 0 | 0 |
| 2 | 165 | " | 2.25 | G | E | 0 | " |
| 3 | 185 | " | 2.3 | G | G | 1 | " |
| 4 | 175 | " | 2.25 | B | E | 0 | " |
| 5 | 105 | 0.05 | 1.55 | G | M | 1 | 0.05 |
| 6 | 100 | 0.05 | 1.50 | G | G | 0 | 0.10 |
| 7 | 105 | 0.05 | 1.60 | G | B | 5 | 0.03 |
| 8 | 90 | 0.05 | 1.4 | B | E | 0 | 0.15 |
| 9 | 160 | 0.04 | 2.20 | B | E | 0 | 0 |
| 10 | 175 | " | 2.30 | G | E | 0 | " |

From the results shown in Table 2, it can be seen that the samples of the present invention show the excellent performance.

Example 2

Preparation of Emulsion C of the Present Invention:

In a reaction vessel was placed 1200 ml of an aqueous gelatin solution (containing 200 g of deionized alkali-treated gelatin, pH 4.3), and while maintaining the temperature thereof at 41° C., 12 ml of the "Ag-1 liquid" and 12 ml of the "X-1 liquid" as used in Example 1 were added to the solution by a double jet method at 50 ml/minute. After stirring the mixture for 2 minutes, 22 ml of the "Ag-2 liquid" and 22 ml of the "X-2 liquid" as used in Example 1 were added to the mixture by a double jet method at 62 ml/minute. Then, after stirring for 2 minutes, 38 ml of the "Ag-1 liquid" and 38 ml of the "X-1 liquid" were added to the mixture by a double jet method at 50 ml/minute. Then, 23 ml of the "NaCl-1 liquid" as used in Example 1 was added to the resulting mixture, the pH thereof was adjusted to 5.0, and the temperature thereof was raised to 75° C. Then, after ripening for 20 minutes, the temperature thereof was lowered to 65° C., and after adding thereto a silver chloride fine grain emulsion (average grain diameter: 0.08 μm) at a silver chloride addition speed of $4\times10^{-3}$ mole/minute for 10 minutes, the fine grain emulsion was further added thereto at a silver halide acceleration addition method of $10^{-4}$ mole/minute for 70 minutes. Thereafter, after ripening for 8 minutes, a precipitant was added to the emulsion formed, the temperature was lowered to 30° C., the precipitates formed were washed with water. Then, an aqueous gelatin solution was added thereto and the pH and the pCl were adjusted to 6.2 and 3.0, respectively, at 38° C.

A part of the silver halide emulsion formed was sampled and when the transmission type electron microphotographic images of the replica of the silver halide grains were observed, the form characteristic values of the silver halide grains were as follows.

That is, $a_1$=0.92, $a_2$=4.5, $a_3$=1.0 μm, $a_4$=0, $a_5$=0.82, $a_6$=0.077, $a_7$=0.22 μm, and the silver chloride content was 98.25 mole %.

Thereafter, soluble salts were removed by a flocculation method. Furthermore, the temperature of the emulsion was raised to 40° C. again, and after adding thereto 7.5 g of gelatin, 0.6 g of phenoxy ethanol, and 0.2 g of sodium polystyrenesulfonate as a thickener, the pH and the pCl were adjusted to 6.2 and 3.0, respectively, with sodium hydroxide.

While stirring the silver halide emulsion thus-prepared and maintaining the temperature thereof at 58° C., $1\times10^{-5}$ mole/mole-Ag of the Thiosulfonic Acid Compound-I shown below was added to the emulsion and then $8\times10^{-4}$ mole/mole-Ag of the Sensitizing Dye-I shown below and $3\times10^{-6}$ mole/mole-Ag of the Sensitizing Dye-II shown below were further added to the emulsion.

Thiosulfonic Acid Compound-I:

$C_2H_5SO_2SNa$

Sensitizing Dye-I

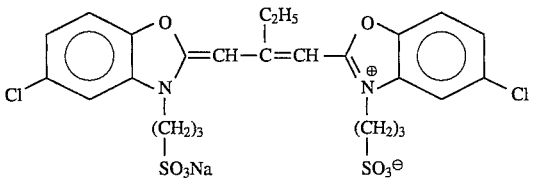

Sensitizing Dye-II

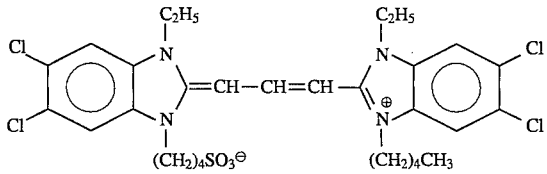

Then, sodium thiosulfate, the Selenium Compound-I shown below, chloroauric acid, and potassium thiocyanate were added to the emulsion, and after most suitably chemically sensitizing the emulsion, the emulsion was cooled to 35° C. to provide Emulsion C of the present invention.

Selinium Compound-I

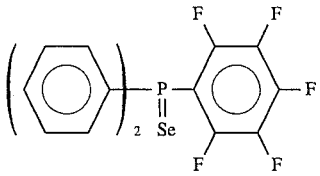

In 2,000 ml of distilled water was dissolved 40 g of gelatin and the solution was stirred in a reaction vessel kept at 40° C. After adjusting the pH of the solution to 3.00 with nitric acid, 33.0 ml of an aqueous silver nitrate solution of a 1 mole concentration and 34.0 ml of an aqueous potassium bromide solution of a 1 mole concentration were added to the solution over a period of 20 seconds. Thereafter, the pAg of the emulsion was adjusted to 6.5 with an aqueous silver nitrate solution, the pH was adjusted to 6.00 with an aqueous sodium hydroxide solution, and then the temperature of the emulsion was raised to 75° C. Immediately after raising the temperature, the pAg was adjusted to 5.79 and physical ripening was carried out for 3 hours. Then, 18.7 ml of an aqueous silver nitrate solution of a 0.01 mole concentration and an aqueous potassium iodide solution of a 0.01 mole concentration were added to the emulsion by a controlled double jet method while keeping the pAg of the system at 5.79. The emulsion was concentrated to 200 ml by a centrifugal separation for 10 minutes at 6,000 r.p.m.

After repeating the foregoing operation 5 times, the concentrated emulsions were mixed and 5 g of gelatin was added to the emulsion.

In the Emulsion C thus-obtained, the tabular silver halide grains substantially composed of silver iodobromide and having an aspect ratio of at least 2, wherein the parallel two major planes were (100) planes, accounted for 84% of the total projected area of the total silver halide grains, the average edge length was 1.12 μm, the thickness between the two major planes was 0.18 μm, and the silver iodide content to silver bromide was 0.6 mole %.

Thereafter, soluble salts were removed by a flocculation method. Then, the temperature of the emulsion was raised to 40° C. again, and after adding thereto 30 g of gelatin, 2.35 g of phenoxy ethanol, and 0.8 g of sodium polystyrenesulfonate as a thickener, the pH and pAg thereof were adjusted to 5.9 and 8.00, respectively, with a sodium hydroxide solution and a silver nitrate solution.

While stirring the emulsion, a chemical sensitization was applied thereto at a state maintained at 56° C.

Then, first, $1\times10^{-5}$ mole/mole-Ag of Thiosulfonic Acid Compound-I shown below was added to the emulsion.

Thiosulfonic Acid Compound-I $C_2H_5SO_2SNa$

Then, 20 ml of 4-hydroxy-6-methyl-1,3,3a,7-tetraazaindene and 80 ml of the Sensitizing Dye-I shown below were added thereto.

Sensitizing Dye-I

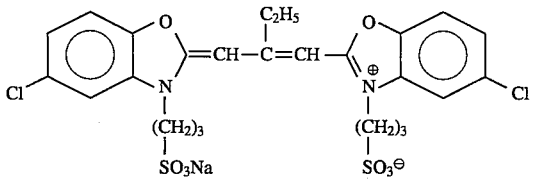

Thereafter, after adding thereto 0.25 mg of sodium thiosulfate, 0.3 mg of the Selenium Compound-1 shown below, 0.5 mg of chloroauric acid, and 20 mg of potassium thiocyanate, the emulsion was cooled to 35° C. after 40 minutes since then to provide Comparative Emulsion D.

Selenium Compound-I

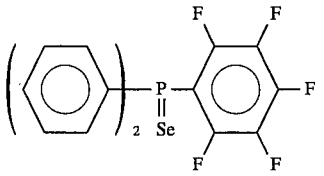

Preparation of Coated Samples:

Coated samples were prepared using the coated solutions prepared by adding the following compounds per mole of silver halide to each of Emulsions C and D prepared above.

| | |
|---|---|
| Gelatin (including gelatin in the emulsion) | By changing the amount, the layer thickness was adjusted. |
| Trimethylolpropane | 9 g |
| Dextran (average molecular weight: 39,000) | 18.5 g |
| Sodium polystyrenesulfonate (average molecular weight: 600,000) | 1.8 g |
| Hardener (1,2-bis(vinylsulfonylacetamide) | By the amount thereof, the swelling amount was controlled. |
| Compound-I (shown below) | 34 mg |
| Compound-II (shown below) | 4.8 g |
| Compound-III (shown below) | 15 mg |

Compound-I

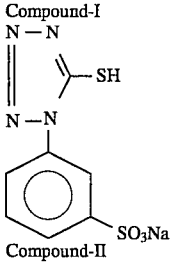

Compound-II

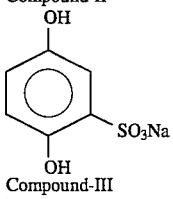

Compound-III

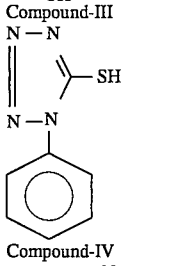

Compound-IV

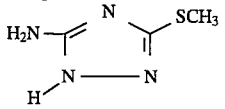

To the coating solution, Dye Emulsion A shown below was added such that the content of Dye-I shown below became 10 mg/m$^2$.

Dye-I

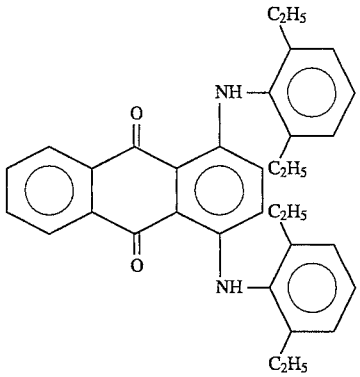

(1) Preparation of Dye Emulsion A:

In a mixture of 62.8 g of the High-boiling Point Organic Solvent-I, shown below, 2.8 g of the High-boiling Point Organic Solvent-II shown below, and 333 g of ethyl acetate was dissolved 60 g of the Dye-I described above at 60° C. Then, after adding thereto 65 ml of an aqueous solution of 5% sodium dodecylsulfonate, 94 g of gelatin, and 581 ml of water, the resulting mixture was emulsion-dispersed for 30 minutes with a dissolver. Then, 2 g of the Compound-IV shown below and 6 liters of water were added thereto and the temperature thereof was lowered to 40° C. Then, the emulsified dispersion was concentrated until the total amount became 2 kg using a ultrafiltration, Labo Module ACP1050 (manufactured by Asahi Chemical Industry Co., Ltd.) and 1 g of the foregoing Compound-IV was added thereto to provide Dye Emulsion A.

High-Boiling Point Organic Solvent-I

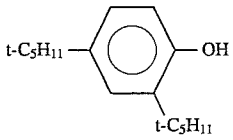

High-Boiling Point Organic Solvent-II

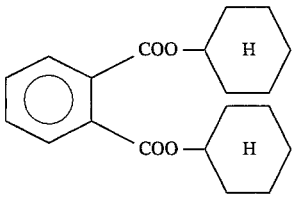

Compound-IV

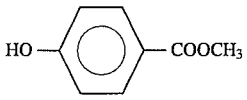

The coating solution for a surface protective layer was prepared such that each component became the following coating amount.

| Gelatin | The layer thickness was controlled by changing the amount thereof. |
|---|---|
| Sodium polyacrylate (average molecular weight: 400,000) | 0.080 g/m$^2$ |
| 4-Hydroxy-6-methyl-1,3,3a,7-tetraazaindene | 0.015 g/m$^2$ |
| Coating Aid-I (shown below) | 0.013 g/m$^2$ |
| Coating Aid-II (shown below) | 0.045 g/m$^2$ |
| Coating Aid-III (shown below) | 0.0065 g/m$^2$ |
| Coating Aid-IV (shown below) | 0.003 g/m$^2$ |
| Coating Aid-V (shown below) | 0.001 g/m$^2$ |
| Compound-V (shown below) | 1.7 mg/m$^2$ |
| Compound-VI (shown below) | 100 mg/m$^2$ |
| Polymethyl Methacrylate (average particle size: 3.7 μm) | 0.087 g/m$^2$ |
| Proxel (pH adjusted to 7.4 with NaOH) | 0.0005 g/m$^2$ |

Coating Aid-I:

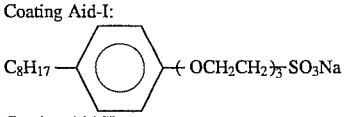

Coating Aid-II:

$C_{16}H_{33}O(CH_2CH_2O)_{10}H$

Coating Aid-III:

$C_{17}H_{33}CON(CH_3)CH_2CH_2SO_3Na$

Coating Aid-IV $C_8F_{17}SO_2N(C_3H_7)(CH_2CH_2O)_{16}H$

Coating Aid-V $C_8F_{17}SO_2N(C_3H_7)(CH_2CH_2O)_4(CH_2)_4SO_3Na$

Compound-V

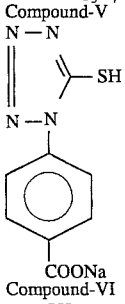

Compound-VI

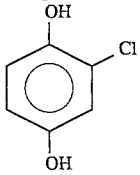

Preparation of Support:

(1) Preparation of Dye Dispersion B for Underlayer

Dye-II shown below was treated with a ball mill by the method described in JP-A-63-197943.

Dye-II

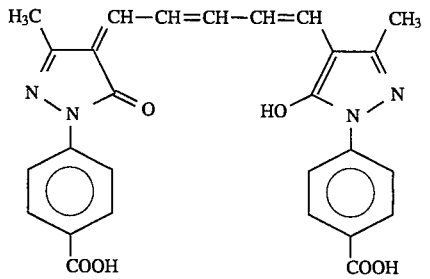

In a 2 liter ball mill were placed 434 ml of water and 791 ml of an aqueous solution of 6.7% surface active agent, Triton X-200 (TX-200) and then 20 g of the dye was added to the solution. Then, 400 ml of beads (diameter: 2 mm) of zirconium oxide ($ZrO_2$) was added to the mixture and the content was ground for 4 days. Thereafter, 160 g of 12.5% gelatin was added thereto. After defoaming, the $ZrO_2$ beads were removed by filtration.

When the dye dispersion obtained was observed, the particle sizes of the ground dye had a wide diameter distribution of from 0.05 μm to 1.15 μm and the average particle size was 0.37 μm.

Furthermore, by a centrifugal separation, the dye particles having the sizes of 0.9 μm or more were removed.

Thus, Dye Dispersion B was obtained.

(2) Preparation of Support

A corona discharging treatment was applied onto a biaxially stretched polyethylene terephthalate film of 175 μm in thickness and after coating the film with the 1st coating solution having the composition shown below by a wire bar coater such that the coating amount became 4.9 ml/m$^2$, the coated layer was dried at 185° C. for one minute.

Then, the opposite surface of the polyethylene terephthalate film was also coated with the 1st coating solution to form the first undercoating layer thereof.

The polyethylene terephthalate film used contained 0.04% by weight of the Dye-I described above.

| | |
|---|---|
| Butadiene-styrene Copolymer Latex Solution (solid component: 40% butadiene/styrene ratio = 31/69 by weight) | 158 ml |
| 2,4-Dichloro-6-hydroxy-s-triazine Sodium Salt Solution (4%) | 41 ml |
| Distilled Water | 801 ml |

The foregoing latex solution contained the following compound as an emulsion dispersing agent in an amount of 0.4% by weight to the latex solid component.

Elmulsion Dispersing Agent:

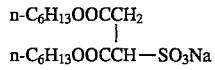

Each of the 1st undercoat layers on both surfaces described above was coated with the coating solution for a 2nd undercoating layer having the following composition by a wire bar coater system such that the coated amount in one side became the amount described below and dried at 155° C. to form the 2nd undercoating layer on each side.

| | |
|---|---|
| Gelatin | 80 mg/m$^2$ |
| Dye Dispersion B (as dye solid component) | 8 mg/m$^2$ |
| Coating Aid-VI (shown below) | 1.8 mg/m$^2$ |
| Compound-VII (shown below) | 0.27 mg/m$^2$ |
| Matting Agent (Polymethyl methacrylate having an average particle size of 2.5 μm) | 2.5 mg/m$^2$ |

Coating Aid-VI:
$C_{12}H_{25}O(CH_2CH_2O)_{10}H$
Compound-VII:

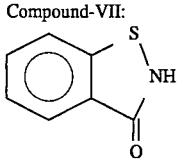

Preparation of Photographic Material:

Each of both the surfaces of the support thus-prepared was coated with the coating solution for the emulsion layer and the coating solution for the surface protective layer prepared above by a simultaneous extruding method. The coated silver amount per one surface was 1.75 g/m$^2$.

Thus, Coated Samples 11 to 20 were prepared. The contents thereof are shown in Table 3 below.

TABLE 3

| Coated sample No. | Emulsion | Emulsion Layer Ag Amount (g/m$^2$) | Emulsion Layer Gelatin (g/m$^2$) | Gelatin amount in the surface protective layer (g/m$^2$) | Emulsion Layer Dry Thickness (μm) | Swelling Amount at the Emulsion Side (μm) | |
|---|---|---|---|---|---|---|---|
| 11 | C | 1.75 | 1.7 | 0.8 | 3.2 | 7.8 | Invention |
| 12 | " | " | 1.4 | 0.8 | 2.8 | 6.6 | " |
| 13 | " | " | 1.2 | 0.6 | 2.4 | 6.0 | Comparison |
| 14 | " | " | 2.0 | 0.9 | 3.6 | 8.2 | " |
| 15 | D | " | 1.7 | 0.8 | 3.2 | 7.8 | " |

TABLE 3-continued

| Coated sample No. | Emulsion | Emulsion Layer Ag Amount ($g/m^2$) | Emulsion Layer Gelatin ($g/m^2$) | Gelatin amount in the surface protective layer ($g/m^2$) | Emulsion Layer Dry Thickness (μm) | Swelling Amount at the Emulsion Side (μm) | |
|---|---|---|---|---|---|---|---|
| 16 | " | " | 1.4 | 0.8 | 2.8 | 6.6 | " |
| 17 | " | " | 1.2 | 0.6 | 2.4 | 6.0 | " |
| 18 | " | " | 2.0 | 0.9 | 3.6 | 8.2 | " |
| 19 | C | " | 2.0 | 1.1 | 3.8 | 10.3 | " |
| 20 | " | " | 2.0 | 1.1 | 3.8 | 7.0 | Invention |

Ag amount was the amount per one surface.

Sensitometry:

After exposing each of the coated samples (Coated Samples 11 to 20) with green light for 1/20 second, the samples were processed by the following automatic processor.

Automatic Processor: The driving motor and gears of FPM-9000 (trade name, manufactured by Fuji Photo Film Co., Ltd.) were improved to increase the transporting speed.

The compositions of the processing solutions used were as follows.

| [Condensed Developer] | |
|---|---|
| Potassium Hydroxide | 56.6 g |
| Sodium Sulfite | 200 g |
| Diethylenetriaminepentaacetic Acid | 6.7 g |
| Potassium Carbonate | 16.7 g |
| Boric Acid | 10 g |
| Hydroquinone | 83.3 g |
| Diethylene Glycol | 40 g |
| 4-Hydroxymethyl-4-methyl-1-phenyl-3-pyrazolidone | 22.0 g |
| 5-Methylbenzotriazole | 2 g |
| Compound shown below | 0.6 g |
| Water to make (pH adjusted to 10.60) | 1 liter |

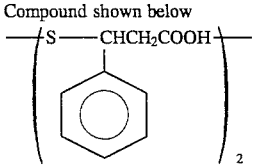

| [Condensed Fixing Solution] | |
|---|---|
| Ammonium Thiosulfate | 560 g |
| Sodium Sulfite | 60 g |
| Ethylenediaminetetraacetic Acid.Disodium. Dihydrate | 0.10 g |
| Sodium Hydroxide | 24 g |
| Water to make (pH adjusted to 5.10 with acetic acid) | 1 liter |

When the development was started, each of the following processing solutions was filled in each tank of the automatic processor.

Developer Tank: Into the tank were added 331 ml of the condensed developer described above, 667 ml of water, and 10 ml of a starter containing 2 g of potassium bromide and 1.8 g of acetic acid and the pH thereof was adjusted to 10.25.

Fixing Tank: Into the tank were added 200 ml of the condensed fixing solution described above and 800 ml of water.

| | |
|---|---|
| Processing Speed: | Dry to dry; 35 seconds |
| Development Temperature: | 35° C. |
| Fixing Temperature: | 32° C. |
| Drying Temperature: | 55° C. |
| Replenishing Amount: | developer: 8 ml/10 × 12 inch fixing solution: 12 ml/10 × 12 inch |

The sensitivity was shown by the reciprocal of the exposure amount giving the density of fog+1.0 and the sensitivity of Sample No. 16 was defined to be taken as 100.

By following the same procedure as Example 1 except the automatic processor processing, the drying property, the roller mark, and the pick off were evaluated. Also, the residual color was evaluated as follows.

Evaluation of Residual Color:

Each coated samples was cut into a size of 30.5 cm×25.4 cm and after treating the sample with water at 5° C., the extent of the residual color of each sample was visually evaluated by the following standard.

E: Almost no residual color.

G: Residual color observed slightly but no problem.

M: Residual color observed but allowable for practical use.

B: Many residual color and unsuitable for practical use.

The results obtained are shown in Table 4 below. From the results, it is clear that the present invention shows an excellent super quick processing suitability.

TABLE 4

| | Sensitivity | Fog | Dmax | Drying property | Roller mark | Pick off | Residual color | |
|---|---|---|---|---|---|---|---|---|
| 11 | 120 | 0.04 | 3.2 | G | E | 0 | E | Invention |
| 12 | 125 | " | 3.2 | G | E | 0 | E | " |
| 13 | 120 | " | 3.2 | G | G | 3 | E | Comparison |
| 14 | 120 | " | 3.2 | B | E | 6 | E | " |
| 15 | 95 | " | 3.1 | G | M | 2 | B | " |
| 16 | 100 | " | 3.1 | G | B | 4 | M | " |

TABLE 4-continued

| | Sensitivity | Fog | Dmax | Drying property | Roller mark | Pick off | Residual color | |
|---|---|---|---|---|---|---|---|---|
| 17 | 100 | " | 3.05 | G | B | 6 | G | " |
| 18 | 100 | " | 3.1 | B | G | 0 | B | " |
| 19 | 115 | " | 3.15 | B | E | 0 | M | " |
| 20 | 115 | " | 3.15 | G | E | 0 | E | Invention |

Example 3

After finishing the formation of the silver halide grains in Example 2, the temperature of the silver halide emulsion was raised to 72° C., after further ripening the emulsion for 10 minutes, a precipitant was added thereto, the temperature was lowered to 30° C., and the precipitates formed were washed with water. An aqueous gelatin solution was added to the emulsion and the pH and the pCl thereof were adjusted to 6.2 and 3.0, respectively, at 38° C.

When the TEM images (transmission type electromicroscopic images) of the replica of the silver halide grains were observed, it was confirmed that the silver halide emulsion obtained was the silver halide emulsion of the present invention wherein about 38% of the total projected area of the tabular silver halide grains having an aspect ratio of at least 2 was the tabular silver halide grains that one of the four corners thereof had a roundish form.

The emulsion was chemically sensitized in the same manner as the Emulsions A and C of the present invention in Examples 1 and 2, respectively and when coated samples were prepared by the same manner as Example 1 except that the amount of silver of the emulsion was replaced with the silver amount of the emulsion of the coated samples 1 and 2, respectively and also by the same manner as in Example 2 except that the silver amount of the emulsion was replaced with the silver amount of the coated samples 11 and 12, respectively, it was confirmed that an excellent super rapid processing faculty was obtained.

Example 4

Silver halide grains were formed according to the procedure in Example 11B of European Patent 0534395A1. A precipitant was added to the silver halide emulsion, after washing the emulsion with water by a flocculation washing method, an aqueous gelatin solution was added thereto, and the pH and pCl thereof were adjusted to 6.2 and 3.0, respectively, at 38° C. The grain form of the TEM images of the replica of the silver halide grains obtained was similar to the grain form shown in FIG. 5 of the European patent described above.

The sensitizing treatment as in the case of the emulsions A and C of Examples 1 and 2 was applied to the emulsion and after adding thereto a thickener and a coating aid, coated samples were prepared by the same coating procedures as those of the coated samples 1 and 2 in Example 1, respectively and evaluated by the same methods as in Example 1. As the results thereof, it was confirmed that the samples of the present invention showed an excellent performance in the points of the sensitometry, the roller mark, the residual silver, etc.

Also, when coated samples were prepared by the same conditions as the cases of preparing the coated samples 11 and 21 in Example 2 of the present invention and evaluated by the same methods as in Example 2, it was confirmed that the samples of the present invention were excellent in the points of the sensitometry, the residual color, and the roller mark.

Example 5

Preparation of Tabular Grains 1:

In a reaction vessel was placed 1200 ml of an aqueous gelatin solution (containing 18 g of deionized alkali-treated bone gelatin having a methionine content of about 40 μmole/g, pH 4.3) and while maintaining the temperature thereof at 43° C., 12 ml of an "Ag-1 liquid" (containing 20 g of silver nitrate, 0.8 g of the foregoing gelatin, and 0.2 ml of an aqueous solution of 1N nitric acid in 100 ml) and 12 ml of an "X-1 liquid" (containing 6.9 g of sodium chloride, 0.8 g of the foregoing gelatin, and 0.3 ml of an aqueous solution of 1N sodium hydroxide in 100 ml) were added to the solution by a double jet method at 24 ml/minute. After stirring the mixture for 2 minutes, 19 ml of an "Ag-2 liquid" (containing 2 g of silver nitrate, 0.8 g of the foregoing gelatin, and 0.2 ml of an aqueous solution of 1N nitric acid in 100 ml) and 19 ml of an "X-2 liquid" (containing 1.4 g of potassium bromide, 0.8 g of the foregoing gelatin, and 0.2 ml of an aqueous solution of 1N sodium hydroxide in 100 ml) were added to the mixture by a double jet method at 31 ml/minute. Then, after stirring the resultant mixture for 2 minutes, 36 ml of the "Ag-1 liquid" and 36 ml of the "X-1 liquid" were added thereto by a double jet method at 48 ml/minute. Then, 20 ml of a "NaCl-liquid" (containing 10 g of sodium chloride in 100 ml) was added to the emulsion obtained, the pH thereof was adjusted to 4.8, and the temperature was raised to 75° C. After ripening the emulsion for 20 minutes, the temperature was lowered to 60° C., and after adjusting the pH thereof to 5.0, an "Ag-3 liquid" (containing 10 g of silver nitrate in 100 ml) and an "X-3 liquid" (containing 3.6 g of sodium chloride in 100 ml) were added to the emulsion at a silver potential of 130 mV by a controlled double jet method. The flow rate at the initiation of the addition of the "Ag-3 liquid" was 7 ml/minute, the flow rate for the addition was accelerated at 0.1 ml/minute, and 400 ml of the "Ag-3 liquid" was added.

Then, fine silver iodide grains having an average sphere equivalent diameter of 0.03 μm were added thereto in an amount of 0.2 mole % per mole of silver halide and the emulsion was ripened for about 5 minutes to complete the halogen conversion.

Then, a precipitant was added to the emulsion, the temperature thereof was lowered to 30° C., after washing the emulsion with water by a flocculation method, an aqueous gelatin solution was added thereto, and the pH and pCl thereof were adjusted to 6.2 and 3.0, respectively, at 38° C. A part of the emulsion was sampled and when the TEM images of the replica of the silver halide grains were observed, the form characteristic values of the silver halide grains were as follows.

(The total projected area of the (100) plane tabular grains having an aspect ratio of at least 2/the sum of the projected areas of the total silver halide grains)=$a_1$= 0.91.

The average aspect ratio (average diameter/average thickness) of (100) tabular grains having as aspect ratio of at least 2=$a_2$=3.4.

The average diameter of the (100) plane tabular grains having an aspect ratio of at least 2=$a_3$=1.0 μm.

(The total projected area of twin grains/the total projected area of the (100) plane tabular grains having an aspect ratio of at least 2)=$a_4$=0.

(The sum of the projected areas of the (100) plane tabular grains having an aspect ratio of at least 2 and an edge ratio of from 1 to 1.4/the sum of the projected areas of the total silver halide grains)=$a_5$=0.94.

(The coefficient of variation of the diameter distribution of the (100) plane tabular grains having an aspect ratio collected in the order of the larger grain sizes up to 70% of the total projected area thereof)=$a_6$=0.059.

Average thickness=$a_7$=0.29 μm.

Then, the silver halide emulsion was chemically sensitized by the same manner as in Example 2.

The amount of each compound being added at the chemical sensitization was controlled in the same manner as in Example 2 such that the photographic sensitivity in the light exposure and the development processing became optimum as in Example 2. Thus, the preparation of the tabular silver halide grains 1 were completed.

Preparation of Tabular Grains 2:

The tabular silver halide grains were prepared by the same manner as the preparation of the tabular grains 1 except that an aqueous solution of potassium iodide corresponding to 0.2 mole % per mole of silver halide was added in place of the fine silver iodide grains in the tabular grains 1. The form characteristic values of the tabular grains 2 thus-obtained were the same as those of the tabular grains 1.

Preparation of Tabular Grains 3:

The tabular silver halide grains were prepared by the same manner as the preparation of the tabular grains 1 except that fine silver bromide grains having an average sphere equivalent diameter of 0.05 μm was added in an amount corresponding to 0.4 mole % per mole of silver halide in place of the fine silver iodide grains in the tabular grains 1. The form characteristic values of the tabular grains 3 thus obtained were the same as those of the tabular grains 1.

Preparation of Tabular Grains 4:

The tabular silver halide grains were prepared by the same manner as the preparation of the tabular grains 1 except that an aqueous solution of potassium bromide was added in an amount corresponding to 0.4 mole % per mole of silver halide in place of the fine silver iodide grains in the tabular grains 1. The form characteristic values of the tabular grains 4 thus-obtained were the same as those of the tabular grains 1.

Preparation of Tabular Grains 5:

The tabular silver halide grains were prepared by the same manner as the preparation of the tabular grains 1 except that the silver halide grains were desalted by a flocculation method and re-dispersed without adding the fine silver iodide grains in the tabular grains 1. The form characteristic values of the tabular grains 5 thus-obtained were the same as those of the tabular grains 1.

Preparation of Tabular Grains 6:

Silver halide grains were formed according to the procedure of Example 11B of European Patent 0534395A1. A precipitant was added to the emulsion, the emulsion was washed with water by a flocculation washing method at 30° C., and after adding thereto an aqueous gelatin solution, the pH and pCl thereof were adjusted to 6.2 and 3.0 at 38° C. respectively. The grain form of the TEM images of the replica of the silver halide grains was similar to the grain form of FIG. 5 of the foregoing European patent.

Preparation of Tabular Grains 7:

The tabular silver halide grains were prepared by the same manner as the preparation of the tabular grains 6 except that in the tabular grains 6, after forming the silver halide grains, fine silver iodide grains having an average sphere equivalent diameter of 0.03 μm were added in an amount corresponding to 0.2 mole % per mole of silver halide and the emulsion was ripened for about 5 minutes to perform a halogen conversion. The form of the tabular grains 7 was the same as that of the tabular grains 6.

Preparation of Tabular Grains 8:

The tabular silver halide grains were prepared by the same manner as the preparation of the tabular grains 6 except that in the tabular grains 6, after forming silver halide grains, fine silver bromide grains having an average sphere equivalent diameter of 0.05 μm were added in an amount corresponding to 0.4 mole % per mole of silver halide and the emulsion was ripened for about 5 minutes to perform a halogen conversion. The form of the tabular grains 8 obtained was the same as that of the tabular grains 6.

Then, each of coating solutions was prepared by adding the compounds as in Example 2 to each of the tabular grains 1 to 8 and each of coated samples 1 to 8 was prepared by coating each coating solution.

Thereafter, each of the coated samples was exposed to green light for 1/20 second and processed by the automatic processor as in Example 2.

The sensitivity was shown by the reciprocal of the exposure amount giving the density of fog+1.0, the sensitivity of the coated sample 5 was defined to be taken as 100 and the results obtained are shown in Table 5 below.

TABLE 5

| Sample No. | Emulsion | Sensitivity | Fog |
|---|---|---|---|
| 1 | Tabular grains 1 | 300 | 0.04 |
| 2 | Tabular grains 2 | 280 | 0.03 |
| 3 | Tabular grains 3 | 290 | 0.03 |
| 4 | Tabular grains 4 | 270 | 0.03 |
| 5 | Tabular grains 5 | 100 | 0.05 |
| 6 | Tabular grains 6 | 150 | 0.06 |
| 7 | Tabular grains 7 | 130 | 0.05 |
| 8 | Tabular grains 8 | 80 | 0.05 |

From the above results, it is clear that the tabular silver halide grain emulsion having a layer containing a silver salt having a solubility lower than that of silver chloride on the surface and/or the inside of the grains shows an excellent photographic performance.

Example 6

The Emulsion A of the present invention and the Comparative Emulsion B were prepared by the same manners as in Example 1, the compounds were added to each emulsion as in Example 1, and coated samples were prepared by using the emulsions A and B.

Also, the coating solution for the surface protective layer of the silver halide emulsion layer and the coating solution for the back surface protective layer were prepared in the same manner as in Example 1.

Using the coating solutions thus-obtained, coated samples were prepared by the same procedure as in Example 1.

Sensitometric Method:

Each of the coated samples was subjected to a sensitometry by the following method to measure the photographic sensitivity.

Each of the coated samples was allowed to stand for 7 days after coating at 25° C. and 60% in humidity and then exposed using a 633 n.m. He-Ne laser exposing portion of AC-1 (manufactured by Fuji Photo Film Co., Ltd.).

Also, each sample was exposed using FCR-7000 (manufactured by Fuji Photo Film Co., Ltd.) equipped with AlGaInP 5 mW 678 n.m. semiconductor laser exposing portion by improving the 780 n.m. semiconductor laser exposing portion of FCR-7000.

Photographic Processing:

Then, each sample thus-exposed was processed using an automatic processor.

The driving motor gear portion of the automatic processor CEPROS-M (manufactured by Fuji Photo Film Co., Ltd.) was improved to set the dry to dry processing time to 30 seconds, 45 seconds, or 90 seconds.

Developer Composition:

Diethylenetriaminepentaacetic Acid 4.0 g

| | |
|---|---|
| Potassium Carbonate | 55.2 g (0.4 mole/liter) |
| Sodium Sulfite | 15.0 g |
| Ascorbic Acid | 40.0 g |
| 1-Phenyl-4-methyl-4-hydroxymethyl-3-pyrazolidone | 5.0 g |
| 5-Methylenetriazole | 0.06 g |
| 2-Mercaptobenzimidazole-5-sulfonic Acid 2,3,5,6,7,8-hexahydro-2-thioxo-4-(1H)-quinazolinone | 0.05 g |
| Potassium Bromide | 2.0 g |
| Water to make | 1 liter (pH adjusted to 10.00 with potassium hydroxide) |
| Fixing Solution Composition: | |
| Ammonium Thiosulfate | 140 g |
| Sodium Sulfite | 15 g |
| Ethylenediaminetetraacetic Acid./disodium.Dihydrate | 25 mg |
| Sodium Hydroxide | up to 1000 ml (pH adjusted to 5.10) |
| Processing Speed: | Dry to dry 30 sec., 45 sec., 90 sec. |
| Development Temperature: | 35° C. (8 sec., 13 sec., 25 sec.) |
| Fixing Temperature: | 32° C. |
| Drying Temperature: | 35° C. |

-continued

| | |
|---|---|
| Replenishing Amount: | developer: 15 ml/10 × 12 inch fixing solution: 15 ml/10 × 15 inch |

The sensitivity was shown by the reciprocal of the exposure amount giving the density of fog+1.0 and the sensitivity of the coated sample 1 in 30 second processing was defined as 100.

The results obtained are shown in Table 6 below.

TABLE 6

| | Coated Sample 1 Emulsion A used | Coated Sample 2 Emulsion B used |
|---|---|---|
| 30 sec. Process | | |
| Sensitivity | 100 | 30 |
| Fog | 0.02 | 0.04 |
| 45 sec. Process | | |
| Sensitivity | 110 | 60 |
| Fog | 0.02 | 0.06 |
| 90 sec. Process | | |
| Sensitivity | 120 | 100 |
| Fog | 0.02 | 0.08 |

As is clear from the results shown in Table 6 above, it can be seen that the photographic material and the developer of the present invention show a good photographic performance.

What is claimed is:

1. A silver halide photographic material comprising a support having thereon at least one silver halide emulsion layer, wherein the swelling amount of the hydrophilic colloid layers including the light-sensitive silver halide emulsion layer and a protective layer coated on at least one side of the support is not more than 10 μm in thickness, wherein at least 60% of the total projected area of the total silver halide grains in at least one silver halide emulsion layer includes tabular silver halide grains having a $Cl^-$ content of at least 20 mole %, a {100} plane as the major plane, a thickness of 0.35 μm or less, an aspect ratio (diameter/thickness) of at least 2, and a sum total of projected areas of twin silver halide grains is not more than 10% of the total projected area of the tabular silver halide grains, and wherein the tabular silver halide grains in the silver halide emulsion have a layer containing at least one silver salt comprising at least one of silverhalobromide and silver haloiodide and at least one of silver thiocyanate and silver selenocyanate.

2. The silver halide photographic material as claimed in claim 1, wherein in the silver halide emulsion, the tabular silver halide grains are chemically sensitized with a selenium compound and/or a tellurium compound.

3. The silver halide photographic material as claimed in claim 1, wherein in the silver halide emulsion, the silver salt in the layer in the tabular silver halide grains has a solubility lower than that of silver chloride on the surface and/or in the inside (excluding the nucleus) of the grains.

4. The silver halide photographic material as claimed in claim 1, wherein the dry thickness of the hydrophilic colloid layers is at least 3.3 μm.

5. The silver halide photographic material as claimed in claim 1, wherein the support has at least one silver halide emulsion layer on both sides thereof, the swelling amount of the hydrophilic colloid layers including the silver halide emulsion layer is not more than 8.0 μm in thickness in each side, and at least one silver halide emulsion layer contains tabular silver halide grains which have a $Cl^-$ content of at least 20 mole %, have a {100} plane as the major plane, have a thickness of 0.35 μm or less, have an aspect ratio of at least 2, and account for at least 60% of the total projected area of the total silver halide grains.

6. The silver halide photographic material as claimed in claim 5, wherein the dry thickness of the hydrophilic colloid layers is at least 2.5 μm.

7. The silver halide photographic material as claimed in claim 1, wherein in the silver halide emulsion, the coefficient of variation of the diameter distribution in the tabular silver halide grains is from 0 to 0.11, when the tabular silver halide grains are collected in the order of the larger projected area up to 70% of the total projected area.

8. The silver halide photographic material as claimed in claim 1, wherein in the silver halide emulsion, at least 47% of the total projected area of the tabular silver halide grains have an edge ratio (the edge length of the long edge/the edge length of the short edge) of from 1 to 1.4.

9. The silver halide photographic material as claimed in claim 1, wherein in the silver halide emulsion, at least 10% of the total projected area of the tabular silver halide grains comprise grains in which one of the 4 corners of the grain is rounded in form.

10. A developing process which comprises developing a silver halide photographic material with a developer containing ascorbic acid or the derivative thereof, said silver halide photographic material comprising a support having formed thereon at least one silver halide emulsion layer, wherein the swelling amount of the hydrophilic colloid layers including the light-sensitive silver halide emulsion layer and a protective layer coated on at least one side of the support is not more than 10 μm in thickness, wherein at least 60% of the total projected area of the total silver halide grains in at least one silver halide emulsion layer includes tabular silver halide grains having a $Cl^-$ content of at least 20 mole %, a {100} plane as the major plane, a thickness of 0.35 μm or less, an aspect ratio (diameter/thickness) of at least 2, and a sum total of projected areas of twin silver halide grains is not more than 10% of the total projected area of the tabular silverhalide grains, and wherein the tabular silver halide grains in the silver halide emulsion have a layer containing at least one silver salt comprising at least one of silver halobromide and silver haloiodide and at least one of silver thiocyanate and silver selenocyanate.

11. A developing process as claimed in claim 10, wherein the developer containing ascorbic acid or the derivative thereof contains at least 0.3 mole/liter of a carbonate.

12. A developing process as claimed in claim 10, wherein the replenishing amount for the developer is not more than 300 $ml/m^2$.

* * * * *